US005798455A

United States Patent [19]

Sakata et al.

[11] Patent Number: 5,798,455

[45] Date of Patent: Aug. 25, 1998

[54] STOREHOUSE FOR USE IN STORAGE OF CLEAN MATERIALS

[75] Inventors: Soichiro Sakata; Hideto Takahashi; Katsumi Sato, all of Kanagawa-ken, Japan

[73] Assignee: Takasago Thermal Engineering Co., Ltd., Tokyo, Japan

[21] Appl. No.: 660,458

[22] Filed: Jun. 7, 1996

[30] Foreign Application Priority Data

| | | | |
|---|---|---|---|
| Jun. 13, 1995 | [JP] | Japan | 7-171374 |
| Mar. 14, 1996 | [JP] | Japan | 8-087576 |
| May 10, 1996 | [JP] | Japan | 8-140767 |

[51] Int. Cl.[6] ..... G01N 13/00; G01R 27/00; G01B 11/00; F24F 7/00

[52] U.S. Cl. ..... 73/64.48; 73/64.52; 55/385.2; 454/187

[58] Field of Search ..... 73/64.48, 64.52; 55/385.2; 414/940; 454/187

[56] References Cited

U.S. PATENT DOCUMENTS

| | | | |
|---|---|---|---|
| 4,923,352 | 5/1990 | Tamura et al. | 414/940 X |
| 5,096,477 | 3/1992 | Shinoda et al. | 454/187 X |
| 5,363,867 | 11/1994 | Kawano et al. | 414/940 X |

FOREIGN PATENT DOCUMENTS

| | | | |
|---|---|---|---|
| 0 450 142 A2 | 10/1991 | European Pat. Off. . | |
| 552 756 | 7/1993 | European Pat. Off. | 414/940 |
| 0 672 445 A1 | 6/1994 | European Pat. Off. . | |
| 4-31740 | 2/1992 | Japan | 73/64.52 |
| 5-286567 | 11/1993 | Japan . | |
| 6-156622 | 6/1994 | Japan . | |
| 7-263172 | 10/1995 | Japan . | |

OTHER PUBLICATIONS

Ryley, A New Method of Determining the Contact Angle Made by a Sessile Drop upon a Horizontal Surface (Sessile Drop Contact Angle), Journal of Colloid and Interface Science, vol. 59, No. 2, Apr. 1977, pp. 243–251.

*Primary Examiner*—Daniel S. Larkin

*Attorney, Agent, or Firm*—Patterson, Belknap Webb & Tyler LLP

[57] ABSTRACT

A storehouse is constituted including a clean room 12 and a storage space 10 for storing clean materials, which is isolated from the clean room. The clean air for storage is generated by a storage air generator 36 and is supplied to the storage space 10 through air supply systems 32, 46. The clean air for storage is purified to such a cleanliness level that it contains hydrocarbon group including methane of less than 10 ppb by using the method of combustion with a catalyst, or purified to such a cleanliness level extent that the contact angle of a pure water droplet or the surface resistivity to the clean material surface can be kept at substantially the same level as that which is indicated immediately after cleaning the material, by using a catalytic reaction tower, an activated charcoal filter, or a fluid bed type adsorbing tower, all of which are made by using materials generating no gaseous impurities. Accordingly, it is possible to effectively prevent the substrate surface from contamination caused by the organic substance. No inert gas is employed, thus ensuring safety operation with an inexpensive running cost.

26 Claims, 18 Drawing Sheets

STOREHOUSE FOR USE IN STORAGE OF CLEAN MATERIALS

BACKGROUND OF THE INVENTION

1. Field of the Invention

Present invention relates to a storehouse for use in the storage of clean materials, and more particularly relates to a locally and spatially defined clean space which is arranged in a clean space, for instance a clean room where semiconductor devices, liquid crystal devices (LCD) and others requiring higher level cleanliness can be manufactured, and which serves as a storehouse for storing clean materials such as finished and/or half-finished semiconductor substrates, LCD substrates, and others.

2. Description of the Related Art

Generally, in the process of manufacturing semiconductor devices, LCD panels, and others, a number of manufacturing steps are needed until they will become commercially acceptable products, starting from their raw materials such as untreated bear semiconductor wafers and glass. For instance, a semiconductor production line for manufacturing 1M DRAM chips from a bear semiconductor wafer includes about 200 steps. Also, in the production line for manufacturing LCD panels, the process of about 80 steps has to be completed starting from the base glass material in order to finish a TFT of 9.4 inch. In these manufacturing processes, it is generally hard to sequentially transfer half-finished products from step to step without causing any accumulation of them at any step. For instance, in the production line of a TFT-LCD, it would sometimes happen that half-finished substrates, which have completed the formation of a predetermined circuit through the preceding steps, still have to rest in a storage space (stocker) provided in the clean atmosphere for several tens of hours before proceeding to the next step to receive necessary further treatment.

It is often experienced that when semiconductor substrates and LCD substrates are held in the ordinary clean room atmosphere, there are found some organic substances which are originated from such atmosphere and deposited on the surfaces of them. For instance, if a silicon wafer for use in a semiconductor substrate, which has the organic substances deposited on its surface, is treated at a temperature higher than 650° C. for forming an insulation oxide film ($SiO_2$), carbonic components in the organic substances would react on silicon wafer to form SiC, which should be then taken into $SiO_2$ film and cause not only remarkable decrease in the dielectric strength of the insulation film but also increase in the leakage current thereof. Another example of the ill effect of the organic substances contained in the clean room atmosphere could be seen in the case where it is deposited on the glass used as a LCD substrate. For instance, if amorphus silicon (a-Si) for use in the formation of a thin layer transistor (TFT) is formed on such a glass substrate having the organic substances deposited thereon, the glass and the a-Si film fail to make an acceptable closer contact therebetween. As described above, once the organic substances contained in the clean room atmosphere is deposited on the surface of the substrate for use in the semiconductor and LCD devices, it results in nothing but leaving only the ill effect over the electrical characteristics thereof.

Thus, in order to lessen and rather completely obviate the occurrence of unacceptable products, a reliable cleaning technique is required for removing the surface deposited organic substances. However, in case of removing such organic substances by employing the known cleaning technique of making use of ultraviolet rays, ozone gas or others, it might require several minutes for completing even a step of cleaning a single substrate, so that if such a cleaning step has to be repeated many times, it would naturally result in reduction of the through-put.

Therefore, there have been attempted a variety of approaches for protecting the substrate surface from the contamination caused by the organic substance (often referred to just as 'organic contamination' hereinafter) which is caused by exposing the substrate to the clean room atmosphere, and there have been proposed various kinds of storehouses for storing half-finished substrates therein without or less causing the organic contamination on the surface thereof.

For instance, there has been proposed a technique in which a chemical filter and a high efficiency air filter like a high efficiency particulate air (HEPA) filter or an ultra low penetration air (ULPA) filter are combined to remove not only the particulate substance but also the gaseous organic matter, thereby preventing occurrence of the organic contamination inside the storehouse. Actually, however, this technique appears not to be always successful because if the high efficiency air filter (like HEPA, ULPA) is arranged upstream of the chemical filter, particulate contaminants generated from the chemical filter per se could not be removed. Contrary to this, there would be caused another problem that if the ordinary high efficiency air filter is disposed at a downstream side of the chemical filter, the gaseous contaminants originating from the materials forming the air filter could not be removed.

For instance, in the unexamined Japanese Patent Publication No. Hei 6(1994)-156622, there is proposed a technique, according to which the storehouse of the substrate (or wafer stocker) is filled with the inert gas in place of the clean air, thereby protecting the substrate from the organic contaminants. By storing the substrate in such an inert-gas-filled storehouse, the surface contamination caused by the organic contaminants might be reduced to about one fifth to a half comparing with the case of storing it in the clean room filled with the clean air. However, use of such an inert-gas- filled storehouse (or a wafer stocker) would be accompanied by not only the issue of rise in the manufacturing cost but also the issue of safety in the working area. The manufacturing cost would be increased owing to large consumption of expensive inert gas, and in the worst case, the workers working around the storehouse might meet with the risk of suffocation, should it happen that a large amount of inert gas accidentally flows out and occupies the clean room.

In the unexamined Japanese Patent Publication No. Hei 5(1993)-286567, another technique is proposed, according to which the half-finished substrate is accommodated and stored in a hermetically sealed vessel or container filled with inert gas. Such a vessel or a container might be suitable for transferring finished IC chips and LCD glass plates from one place to the other leaving them as they are hermetically kept therein. However, it would not be always suitable for storing half-finished products or materials therein, because they require in general to be frequently taken out of and again put in the vessel or container before they become complete products.

SUMMARY OF THE INVENTION

The present invention has been made in view of the above-mentioned problems involved in the conventional storehouse for use in the storage of clean materials.

Accordingly, it is an object to provide a novel and improved storehouse which can store clean materials, for instance semiconductor substrates, LCD substrates, etc., without causing any serious organic contamination over them, and which make use of no inert gas as a storage atmosphere, thus being made safely operable at a lower running cost, and which, furthermore, allows the clean materials to be safely and recurrently carried in and out of it.

In order to solve the above-mentioned problems, according to the first aspect of the invention, there is provided a storehouse for use the in storage of the clean material, which comprises an environmental clean space being kept at a level of a first cleanliness, a first local clean space which is isolated from said environmental clean space and is provided with a storage means for storing the clean material, means for generating the clean air for storage, said clean air for storage being controlled to have such a second cleanliness level that it contains a hydrocarbon group including methane of less than 10 ppb and means for supplying said clean air for storage to said first local space. With provision of the storehouse as constituted above in the environmental clean space, the surface of the substrate can be effectively protected from the contamination caused by the organic contaminants. In this case, no inert gas is used, thus enabling the storehouse to be safely operated at an inexpensive running cost.

According to another aspect of the present invention, there is provided a storehouse for use in the storage of the clean material, which comprises an environmental clean space being kept at a level of a first cleanliness, a first local clean space which is isolated from said environmental clean space and is provided with a storage means for storing the clean material, means for generating the clean air for storage, said clean air for storage being controlled to have such a second cleanliness level that the contact angle of a pure water droplet or the surface resistivity to the clean material surface can be kept at substantially the same level as that immediately after cleaning the material, and means for supplying said clean air for storage to said first local space. As a result of constituting the storehouse like the above, the first local clean space for storing the clean material is filled with the clean air for storage which is controlled such that the contact angle of a pure water droplet or the surface resistivity to the clean material surface can be kept at substantially the same level as that immediately after cleaning the material. Consequently, the surface of the substrate can be effectively protected from the organic contamination. In this case, no inert gas is employed, thus enabling the storehouse to be safely operated at an inexpensive running cost.

Said means for generating the clean air for storage may be constituted as means for removing the hydrocarbon group with the help of the so-called method of combustion with tone catalyst, which has the air containing such group contacted at a temperature of 200° C. to 450° C., with a noble metal catalyst such as platinum, palladium, etc. or an oxide catalyst such as copper, manganese, chromium, nickel, iron, etc. to decompose the hydrocarbon group into carbon dioxide and water. According to this method, it is easily made possible to obtain the clean air of which the concentration of the hydrocarbon group is controlled to be less than 10 ppb, but which has been hardly obtainable as long as relying on the conventional chemical filter.

Furthermore, said means for generating the clean air for storage may be preferably constituted as means for removing a hydrocarbon group, which adopts the activated charcoal filter or the fluid bed adsorbing tower using the activated charcoal filtering media, in order to remove the hydrocarbon group contained in outdoor air or said environmental clean atmosphere. Since the activated charcoal itself may generate some particulates (including itself), even though their quantity as generated is so small, it is preferable to provide an air filter or filters (e.g. a high efficiency filter capable of removing particulates with size of 0.3 μm at an efficiency of 99.97% or more or, both a medium efficiency filter capable of removing particulates with size of 0.3 μm or more at an efficiency of less than 99.97% and said high efficiency filters) at downstream side of said means for removing the hydrocarbon group. However, in case of the ordinary medium and high efficiency (HEPA or ULPA) filter, a certain binder containing the volatile organic substance is generally used for fabrication thereof, so that a certain organic gas inevitably comes out therefrom. Accordingly, it is preferable to use the filtering media in which no binder is used or the volatile organic substances, even though used initially, has been removed later by a proper treatment such as baking or the like. Also, for fixing the filtering media to the filter frame, it is preferable to select a sealing material generating no organic contaminant gas, as means for fixing the filtering media to the filter frame, or to physically fix it thereto using the method of pressure welding. In the way as described above, it is made possible to produce the clean air controlled such that the contact angle of a pure water droplet on the clean material surface or the surface resistivity of the same can be kept at substantially the same level as that immediately after cleaning it.

The first local clean space can be constituted with a storage space in which said storage means is set up, and a buffer space intervening between said storage space and said environmental clean space. In this case, it is preferable that said storage space is isolated from said buffer space by a partition wall which can be opened and shut, while said buffer space is isolated from said environmental space by the like partition wall. According to the above-mentioned constitution, when carrying the clean material in the storage space, it is first carried in the buffer space from the environmental clean space after isolating the storage space from the buffer space. Then, the buffer space is filled with the clean air for storage after isolating it from the environmental clean space. After this, the clean material is carried in the storage space. Consequently, the organic substances contained in the atmosphere of the environmental clean space is effectively prevented from immigrating into the storage space. In the same manner, for carrying out the clean material from the storage space, the clean material is first taken out of the storage space after isolating the buffer space from the environmental space. Then, the clean material is carried in the environmental clean air space after isolating the buffer space from the storage space. As a result of this procedure, there is eliminated the fear that the organic substances contained in the atmosphere of the environmental clean space enters in the storage space. Accordingly, it is made possible to construct the storehouse suitable for storing the half-finished products which are inevitably repeating "carried in and out" to the storage space.

As described in the above, if the first local clean space consists of a storage space having said storage means as set up therein, and a buffer space intervening between said storage space and said environmental clean space, and in addition, if there is provided means for supplying the clean air for storage, which flows the clean air for storage from the storage space to the buffer space, it is effectively prevented that the air contaminated in the environmental atmosphere enters in the storage space from the buffer space.

Furthermore, there may be provided in said storehouse the second local clean space which is isolated from both said first local clean space and said environmental clean space, and in which there are provided a gas introducing means for introducing the clean air for storage from said first local clean space into said second local clean space and an assessment device for assessing organic contamination caused by some contaminants existing in the clean air for storage. With provision of such assessment device, the degree of the organic contamination in the first local clean space can be always monitored with time, so that an effective and immediate countermeasure against the organic contamination can be taken before the organic contamination is largely developed in the first local clean space, thereby the material stored therein being so contaminated that the production yield is reduced badly. Furthermore, owing to the use of this assessment device, it can be clearly known when the activated charcoal filter should be replaced. The timing of replacing the charcoal filter has been an controversial issue to be solved so far.

With the provision of such assessment device, the air supply means can be constituted with a plurality of air supply systems which are made independent from each other and can be switched from one to the other to supply said clean air for storage to said first local clean space in response to the assessment result obtained by said assessment device. Since the air supply means includes a plurality of air supply systems, if the assessment device judges that the degree of organic contamination in the first local clean space is getting worse, the air supply system now in operation is interrupted based on the judgement that the air for storage produced through this current system has been contaminated with hydrocarbon group, and is switched to the other air supply system in order to supply to the first local clean space, the fresh clean air which is controlled such that the contact angle of a pure water droplet on or the surface resistivity of the clean material surface can be kept at substantially the same level as that immediately after cleaning it.

Furthermore, the storehouse can be constituted to have an inert gas supply means for supplying the inert gas to said first local clean space, and said air supply means is switched to said inert gas supply means in response to the assessment result obtained by said assessment device. With provision of the inert gas supply means, if the assessment device judges that the degree of organic contamination in the first local clean space is getting worse, the currently operated air supply system is interrupted , and is switched to the inert gas supply means for supplying the inert gas to the first local clean space. While the inert gas is being supplied, there are taken necessary steps for air conditioning, for instance replacement of the activated charcoal filter in the air supply system. When this has newly achieved the clean air for storage that can keep the contact angle of a pure water droplet on or the surface resistivity of the clean material surface at substantially the same level as that immediately after cleaning it, the inert gas supply means is again switched to the former air supply system.

The assessment device for assessing the degree of organic contamination can be constituted with a substrate at least the surface of which is insulated, a surface resistivity meter for measuring the electric resistance between at least two points on said substrate surface, means for introducing to said second local clean space a humidity controlled gas having a substantially constant relative humidity, and means for assessing the degree of contamination occurring on said substrate in view of the surface resistivity measured by said surface resistivity meter and diagnosing (or monitoring) the deterioration of the capability of removing organic substance in said means for generating the clean air for storage. It is a well known fact that in the atmosphere with a constant relative humidity, the surface resistivity of an insulating surface changes depending on the degree of organic contamination occurring on said surface. Accordingly, if the surface resistivity of the substrate having the insulating surface and located in the second local clean space is measured at a predetermined interval, the degree of organic contamination occurring on said surface can be assessed based on the increase rate in the surface resistivity.

Alternatively, the assessment device for assessing the degree of organic contamination can be constituted with a substrate, means for dropping a pure water droplet onto the surface of said substrate, means for measuring the contact angle of said dropped water droplet, and means for assessing the degree of contamination occurring on said substrate in view of the contact angle as measured and diagnosing (or monitoring)the deterioration of the capability of removing organic substances in said means for generating the clean air for storage. It is a well known fact that the contact angle of the water droplet dropped onto the surface changes depending on the degree of organic contamination occurring on said surface. Accordingly, if the contact angle of the water droplet dropped onto the substrate placed in the second local clean space is measured at a predetermined interval, the degree of organic contamination occurring on said surface can be assessed based on the increase rate in the contact angle.

It is preferable that the quality of the material forming the surface of said substrate is made substantially identical to that of the clean material stored in said first local clean space, and also it is preferable that the time for which the material forming the surface of said substrate is exposed to the atmosphere after cleaning the material forming the surface of said substrate is made to be substantially the same as the time for which the material stored in said first local clean space. This provides more accurate assessment over the degree of organic contamination in the first local clean space and diagnosis (or monitoring) of the deterioration of capability of removing organic substances in said means for generating the clean air for storage.

BRIEF DESCRIPTION OF THE DRAWINGS

FIG. 8(*b*) is a schematic perspective view of a metal frame used for a filter as shown in FIG. 7;

DETAILED DESCRIPTION OF THE PREFERRED EMBODIMENT

A storehouse for storing the clean material preferably embodied according to the present invention will now be described in detail in the following, with reference to the accompanying drawings.

Figure 1:
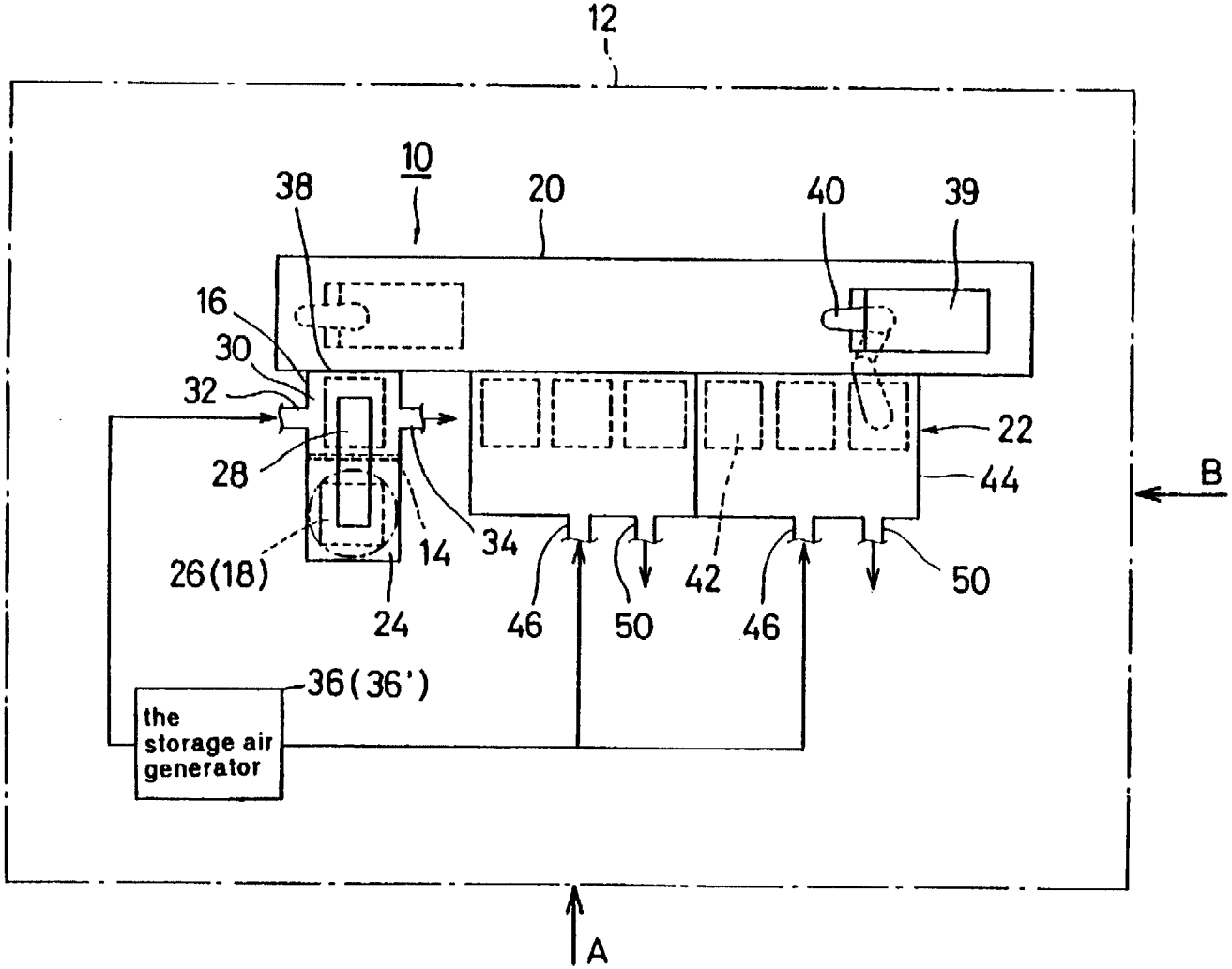
FIG. 1 is a schematic plan view showing an exemplary storehouse for the clean material, embodying the present invention.
Figure 2:
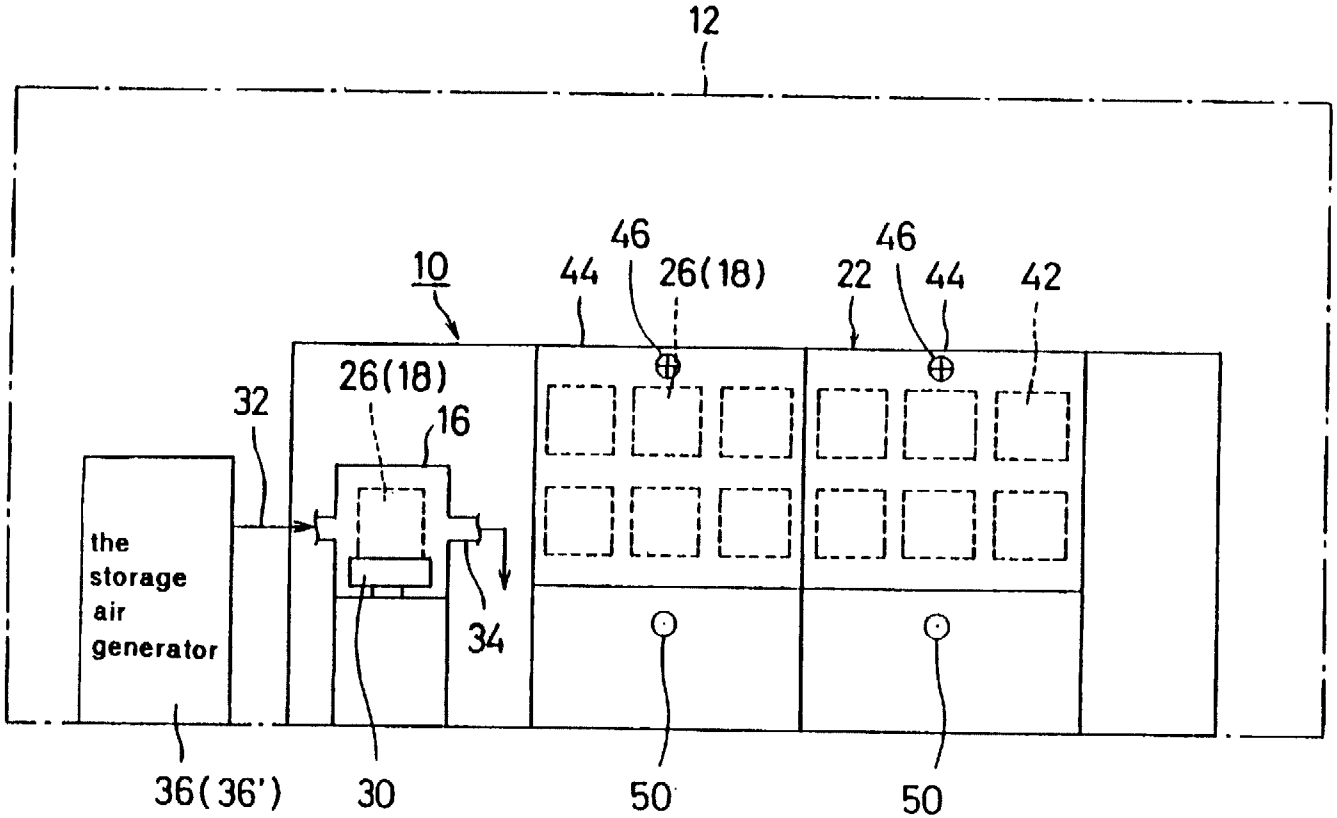
FIG. 2 is a side view of the storehouse for the clean material viewing in the direction of an arrow A as shown in FIG. 1.
Figure 3:
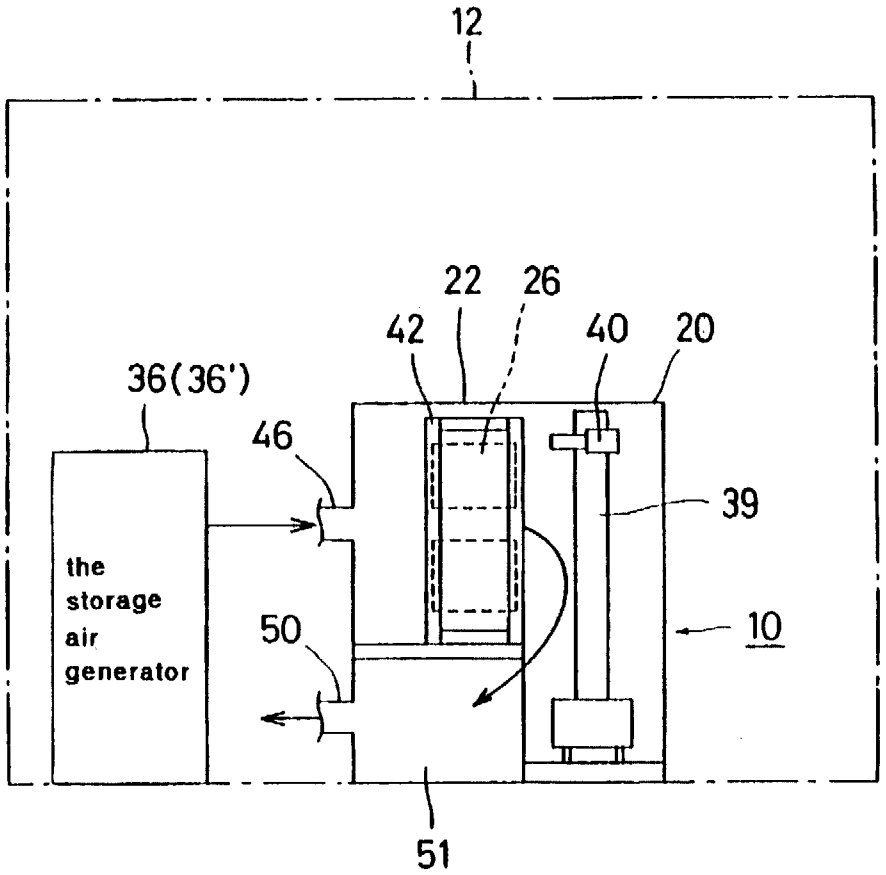
FIG. 3 is a side view of the storehouse for the clean material viewing in the direction of an arrow B as shown in FIG. 1.

FIGS. 1 to 3 show a storehouse 10 which is constituted as the first embodiment according to the present invention, for suitably storing the LCD substrate, FIG. 1 being a plan view of the storehouse 10, FIG. 2 a side view of the same viewing it in the direction of the arrow A in FIG. 1, and FIG. 3 a side view of the same viewing it in the direction of the arrow B in FIG. 1.

As shown in these figures, the storehouse 10 is constructed as a first local clean space which is arranged inside but isolated from a clean environmental space (a clean room) 12 having the first cleanliness. The storehouse 10 is isolated from the clean room 12 with the help of a partition wall 14, and includes a front room 16 serving as a buffer space, through which the LCD substrate 18 is handed over from the clean room 12 to the storehouse 10 or vise versa, a transfer room 20 for transferring the LCD substrate 18, and a storage room 22 for actually storing the LCD substrate 18. In the example as shown in the figure, the transfer room 20 and storage room 22 are arranged so as to have a common space(storage space). However, these rooms 20, 22 may be separated from each other by means of a partition wall which can be opened and shut, thereby preventing the contaminant originated from the transfer room 20, from entering in the storage room 22.

In the clean room 12, there is provided adjacent to the partition wall 14 of the front room 16 a carrier stand 24, on which there is mounted a carrier 26 capable of accommodating a predetermined number of LCD substrates. The front room 16 is provided with a transfer mechanism such as a transfer arm 28 capable of transferring the carrier 26 accommodating LCD substrates from the carrier stand 24 to the carrier stand 30 provided in the front room 16. The front room 16 is further provided with an air supply system 32 from which the clean air for storage can be introduced therein, said clean air for storage being generated by a generator of the clean air for storage (referred to as 'storage air generator' hereinafter) 36 i.e. a combustion apparatus using a catalyst which will be described later in connection with FIG. 5 and also generated by another storage air generator 36' i.e. an activated charcoal filter unit which will be described later in connection with FIG. 6. The front room 16 is also provided with an exhaust system 34 by which the front room can be exhausted if so needed.

Furthermore, the front room 16 and the transfer room 20 are separated from each other by means of another partition wall 38 which can be opened and shut. The transfer room 20 includes a movable stand 39 which is allowed to move along the storage room 22 and on which a transfer arm 40 is installed. For instance, when storing the clean material in the storage room, the partition wall 38 is opened and the carrier 26 placed on the carrier stand 30 in the front room 16 is taken out by the transfer arm 40. The carrier 26 as taken out is then carried by the movable stand 39 up to a vacant stocker located in the storage room 22 and is eventually accommodated therein.

A plurality of stockers 42 are arranged in the storage room 22. FIGS. 1 to 3 show two stocker units 44 which are put side by side, each including stockers which are arranged 3 each on the upper and lower rows. However, it should be noted that these illustrations are just an example, and it is a matter of course that the present invention is not to be limited by these illustrations and may be applicable to the storage room 22 including arbitrary numbers of stocker units and stockers arranged therein with an arbitrary design. The stocker as shown in these figures are constituted to receive the carrier 26 containing the LCD substrates. However, the stocker may be constituted to directly receive the LCD substrate.

Figure 4:
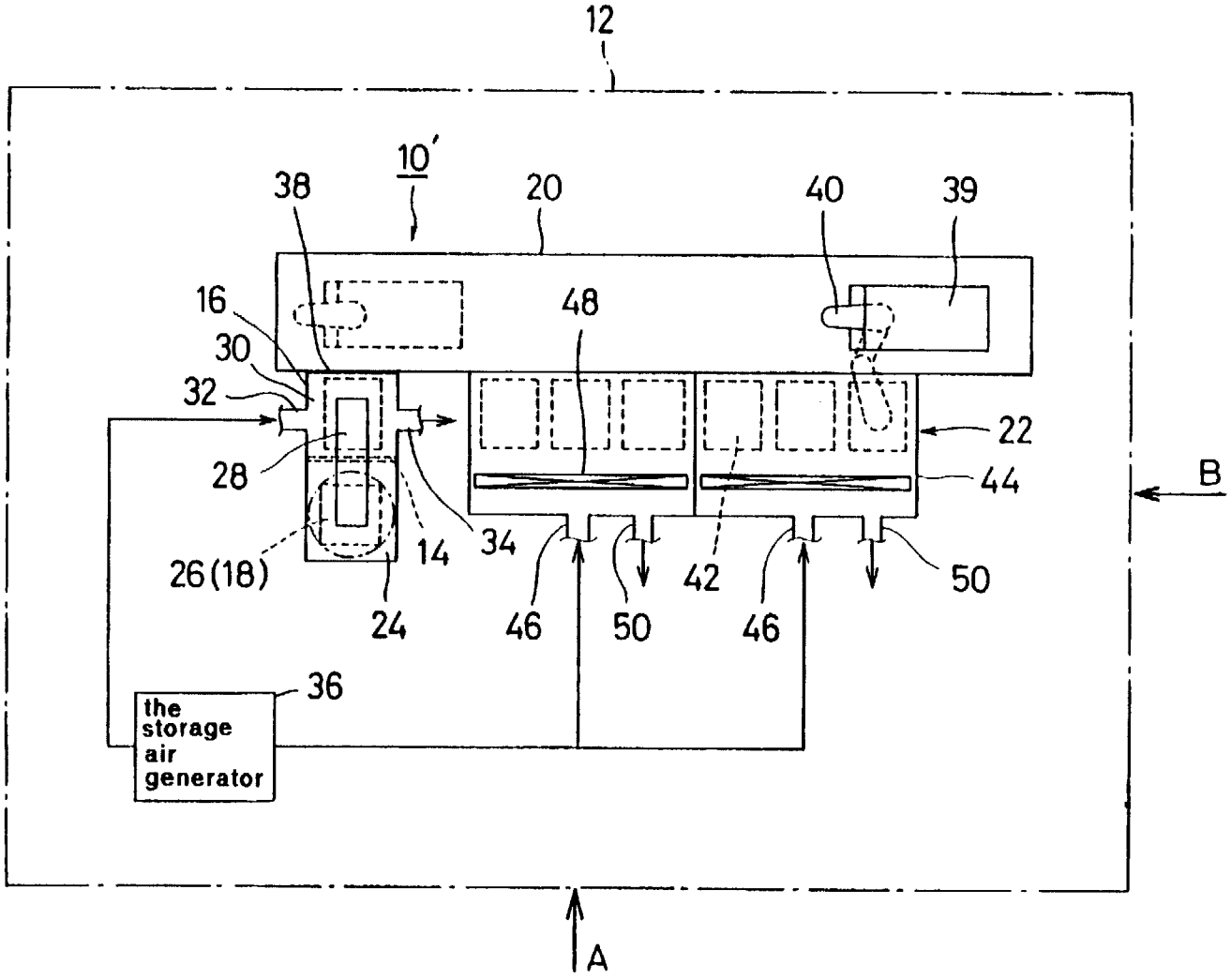
FIG. 4 is a schematic plan view showing another exemplary storehouse for the clean material, embodying the present invention.

In addition to the above arrangement, as shown in FIG. 4, it is possible for the storage room 22 of the storehouse 10' to be provided with an intake system 46 and a high efficiency filter 48. According to this arrangement, it becomes possible for the storage room 22 to be supplied through the high efficiency filter 48 with the controlled clean air which is generated by the storage air generator 36 (described later in connection with FIG. 5) so as to have the second level of cleanliness reducing the total concentration of the hydrocarbon group therein to less than 10 ppb. In the present specification, the cleanliness of the clean room as an environmental clean space is denoted as the first cleanliness while the cleanliness of the local clean space is denoted as the second cleanliness. However, these may be arbitrarily defined including the case where both are made equal. Furthermore, in FIG. 4, the second cleanliness is achieved by the filters 48 of the storage room 22, but it may be also possible to achieve this cleanliness at the stage of the storage air generator 36 by additionally using appropriate filtration means. The storage room 22 is provided with an exhaust system 50 for exhausting the storage room 22 if so needed.

Figure 5:
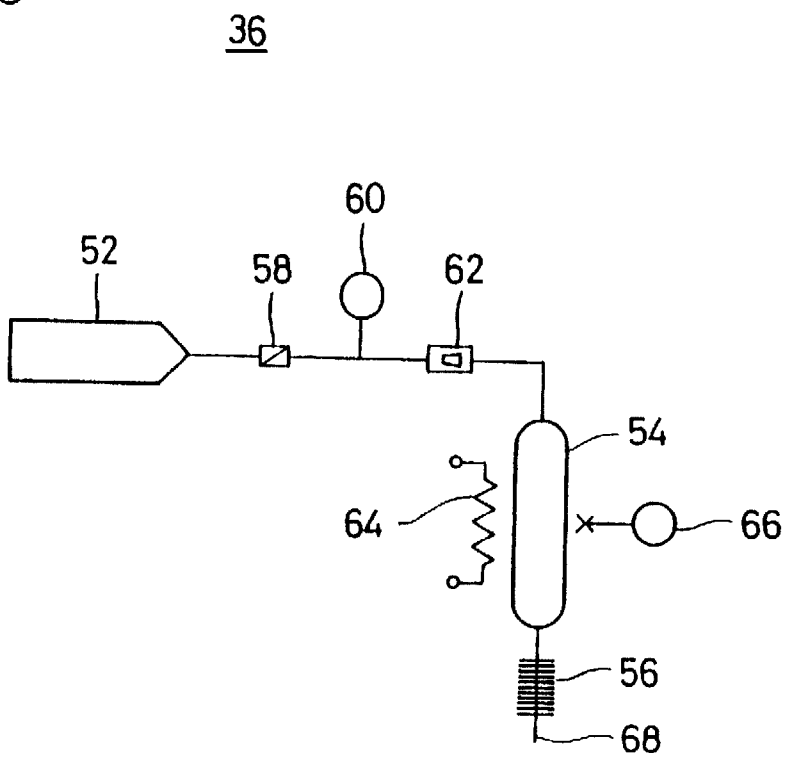
FIG. 5 is an illustration showing the constitution of an exemplary generator of the clean air for storage, suitably applicable to the storehouse as shown in FIG. 1.

Next, referring to FIG. 5, the storage air generator 36 will be described which is applied to the storehouse 10' shown in FIG. 4 to generate the clean air for storage. As will seen in the figure, the generator 36 is constituted mainly with a compressor 52 for compressing air taken therein, a reaction tower 54 for heating air and reacting a catalyst thereon, and a heat exchanger 56 for cooling air after completion of treatment thereof. Furthermore, this generator 36 includes a gas filter 58, a pressure gauge 60, and a flowmeter 62, all of which are disposed on the air flow path between the compressor 52 and the reaction tower 54, in order to adjust the cleanliness, pressure, and flow of air generated by said storage air generator. The reaction tower 54 includes an oxide catalyst such as platinum or palladium, with the help of which the hydrocarbon group contained in the air heated by the heater 64 is decomposed through the chemical reaction as described below. A reference numeral 66 in FIG. 5 denotes a temperature indicator having the function of adjusting temperature as well as the function of issuing an alarm signal.

$$2CnHm+(m/2+2n)O2\rightarrow 2nCO2+mH2O$$

As described in the above, the clean room air or the outdoor air is supplied by the compressor 52, to the reaction tower 54 as heated, for instance at a temperature of 420° C., in which the hydrocarbon group contained in the supplied air is decomposed into water and carbon dioxide through the interaction with the catalyst and is removed. Usually, the clean room air contains the water content of 10,000 ppm to 20,000 ppm, carbon dioxide of several hundred ppm, and hydrocarbon group including methane of several ppm in total, so that even though the hydrocarbon group is entirely burned and decomposed, the amount of water content and carbon dioxide would show only slight increase comparing with those which are originally contained in the air. The clean air from which the hydrocarbon group has been removed in the course of said combustion and decomposition process, is cooled down to the room temperature while passing through the heat exchanger 56 having cooling fins, and is then taken out from a takeout port 68 of the clean air.

In the next, referring to FIG. 6, another storage air generator 36' will be explained which is applied to the storehouse 10 as shown in FIGS. 1 to 3 and generates the clean air for storage. As shown in the FIG. 6, the storage air generator 36' comprises a blower 652 for supplying the air in the unit or for circulating the air through the system, a prefilter 654 for preventing the activated charcoal filter from being clogged up with dusts and particulates in the air, an activated charcoal air filter 656 for adsorbing and removing the hydrocarbon group in the air, and a particulate air filter 658 which is disposed at a downstream side of the activated charcoal filter, to catch and remove charcoal particles which might be generated by the activated charcoal filter. The blower 652 is under the frequency control by an inverter 660, so that the air volume supplied by it can be arbitrarily adjusted.

The activated charcoal filter 656 is classified according to the type of activated charcoal used as a basic filtering media into a pellet type activated charcoal filter, a fiber type activated charcoal filter, and a honeycomb type activated charcoal filter. In the present embodiment, in order to avoid gaseous impurities which might originate from the activated charcoal, the activated charcoal of spherical pellet type was used as a filtering media, which is prepared without using any adhesive. In case of the activated charcoal filter of fiber type and honeycomb type, they are fabricated in general by using other organic fibers and some adhesives to obtain designed shape and durability, so that such organic fibers and adhesives are apt to act as organic gas sources. Even in the case of the activated charcoal of the pellet type, if it is fixed to a urethane base by using the adhesive, undesirable organic gas would come out from such adhesive and urethane base. Since such organic gas acts as a secondary contamination source, some countermeasure would have to be taken thereagainst. Accordingly, in the embodiment of the present invention, there is employed the way of filling spherical activated charcoal pellets in a vessel which is formed of a material generating no organic gas. As a material producing no gaseous impurities, it would be possible to use such a metal as stainless steel and aluminum which are treated through the degreasing process, and have anticorrosive properties and smaller surface roughness as well, or to use such ceramics as alumina and zirconium. In case of stainless steel, it is preferable to use that which has been electrolytically polished while in case of aluminum, it is preferable to use that which the boehmite treatment is applied to its surface.

Figure 6:
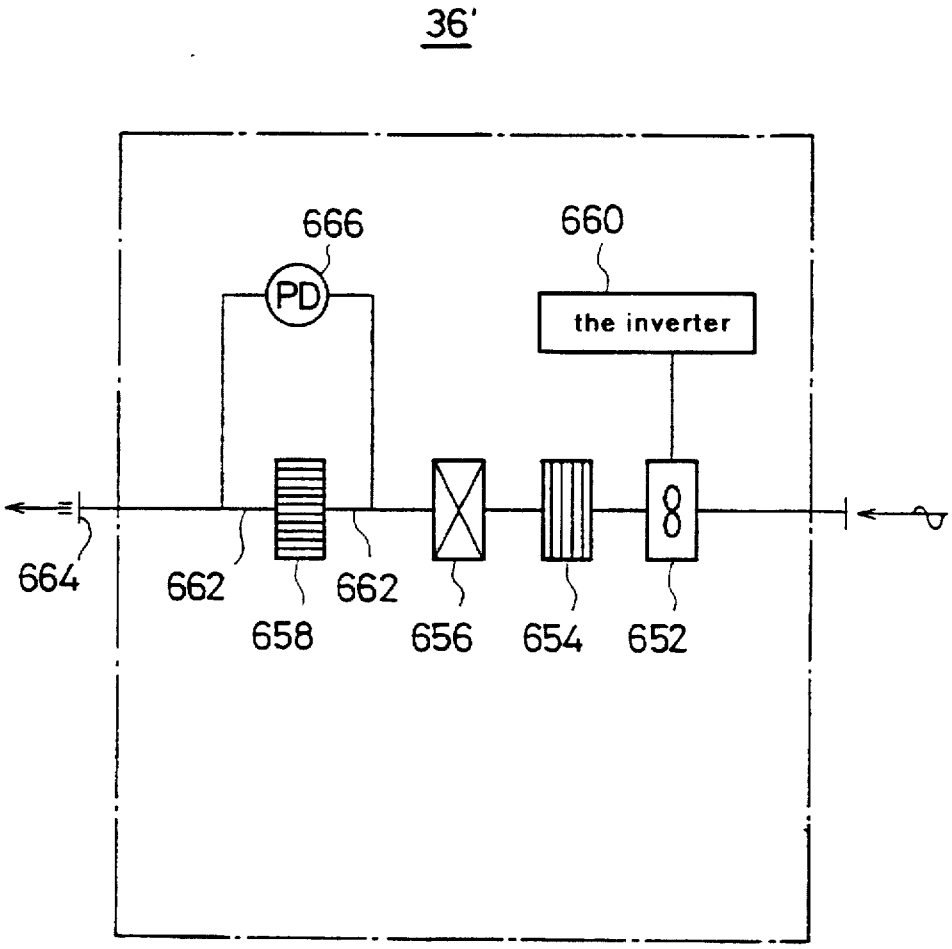
FIG. 6 is an illustration showing the constitution of an exemplary generator of the clean air for storage, suitably applicable to the storehouse as shown in FIG. 1.
Figure 7:
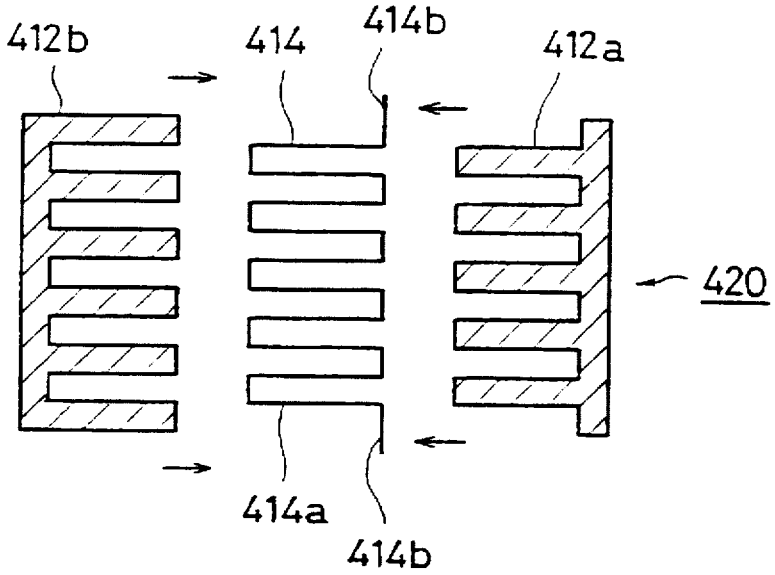
FIG. 7 is a schematic illustration showing the components of a filter suitably applicable to the generator of the clean air for storage as shown in FIG. 6.
Figures 8A, 8B:
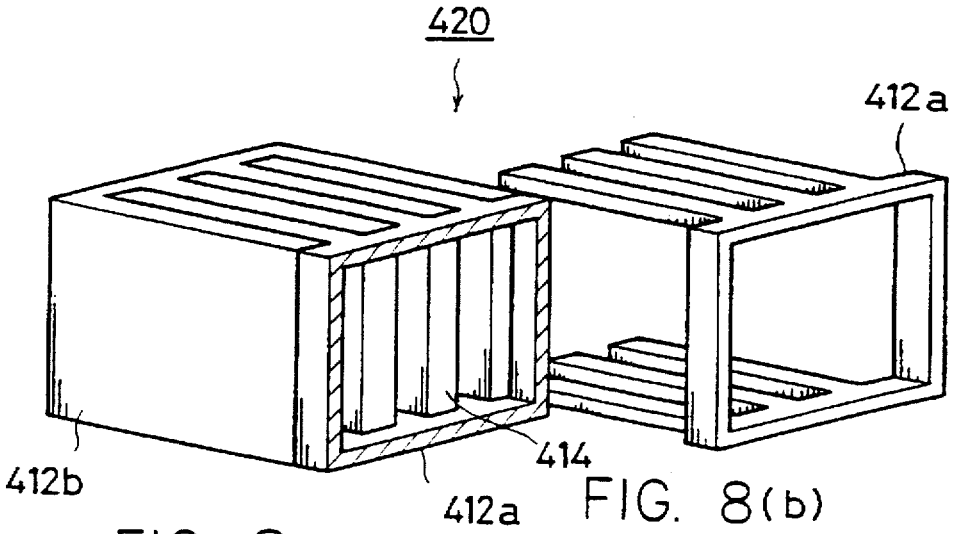
FIG. 8(*a*) is a schematic perspective view of a filter after assembling its components as shown in FIG. 7.

FIGS. 7 and 8 show an example of the filter which is formed of materials which produce no gaseous impurities. A filter 420 is constituted only with a glass fiber filtering media 414 and a pair of metal frames 412*a*, 412*b* made of stainless steel or aluminum, for instance. As shown in FIG. 8, *a* filter element is formed by folding, in an uneven fashion like rectangular pulse wave form, a sheet of filtering media 414 formed of glass fibers without using no binder (if used, volatile organic substances contained therein will be removed through the baking treatment). Upper and lower end parts 414*a* of the filter element are firmly held between uneven portions of a pair of the metal frames 412*a*, 412*b* (i.e. upper and lower surfaces of the metal frame 412*a*, 412*b* as shown in FIGS. 8(*a*) and 8(*b*)). Left and right side parts 414*b* of the filter element are firmly held by the flat end faces of a pair of the metal frames 412*a*, 412*b* (FIGS. 8(*a*) and 8(*b*)). In this way, a filter unit 420 as shown in FIG. 8(*a*) can be assembled without using any material generating undesirable gaseous impurities. FIG. 8(*a*) is a perspective view of the particulate filter unit after assembling thereof while FIG. 8(*b*) is a perspective view of a half part 412*a* of said metal frame pair. The particulate filter unit 420 as assembled in this way is then entirely baked at a high temperature, for instance at a temperature of 300° C. in order to ensure the removal of all the organic substances. This filter unit 420 is then installed between air flow paths 662 (FIG. 6). In this case, a packing made of fluororesin is used for sealing purpose because it generates no organic gas at a room temperature.

Figure 9:
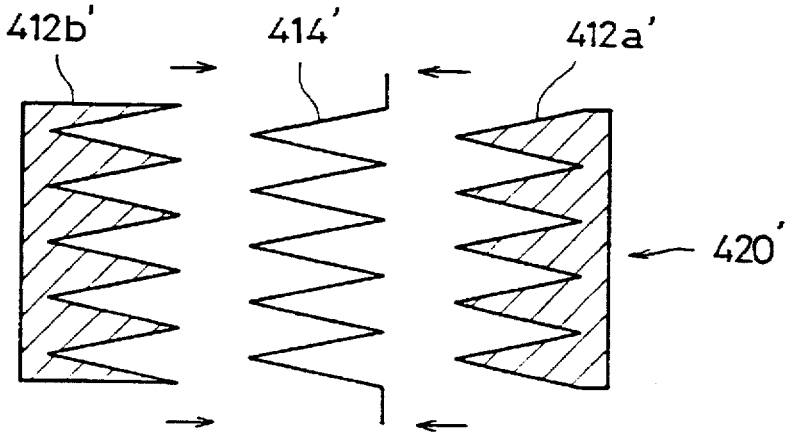
FIG. 9 is a schematic illustration showing another type of a filter applicable to the generator of the clean air for storage as shown in FIG. 6.

Alternatively, it is also possible to fabricate the filter unit in such a manner as shown in FIG. 9. The filter unit 420' shown in FIG. 9 is different from the filter unit 420 shown in FIGS. 7 and 8 in the following point. That is, a filter element is formed by folding, in a zigzag fashion like a sawtooth pulse wave form, a sheet of filtering media 414' made of glass fibers without using no binder (if used, volatile organic substances contained therein will be removed through the baking treatment), and then the filter element is firmly held between a pair of the metal frames 412a', 412b', each being formed to have a zigzag portion corresponding to that of the filter element. Accordingly, except the difference in the form, the particulate air filter unit 420' of FIG. 9 has substantially the same constitution as the particulate air filter unit 420 shown in FIGS. 7 and 8, so that the detailed description there about will be refrained from.

Figure 10:
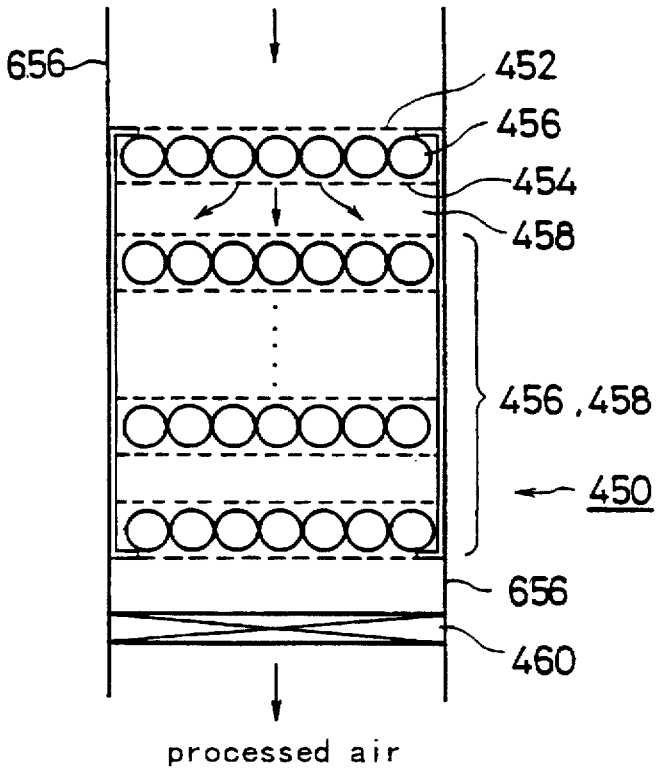
FIG. 10 is a schematic illustration showing another type of a filter applicable to the generator of the clean air for storage as shown in FIG. 6.

FIG. 10 shows another way 450 of installing the activated charcoal filter 656 and the particulate air filter 658 on the air flow path 662 (FIG. 6). As shown in the figure, the activated charcoal filter 656 according to the present invention is constituted with a plurality of filtration unit stages, each unit stage comprising a monolayer of spherical activated charcoal 456 disposed between stainless meshes 452, 454 and a space 458 provided beneath said each activated charcoal layer, including also a particulate air filter 460 which is located after the last activated charcoal layer and is for removing secondary particles supposed to come from the activated charcoal layer. In the manner as described above, stacking plural spherical activated charcoal layers by putting one space each there between is useful for obtaining a filter structure having a lower pressure drop. For all the constituents of this filter are employed the materials that generate no gaseous impurities, thereby preventing the filter itself from acting as a contaminant source.

Again referring to FIG. 6, the clean air after removing organic gas through the above activated charcoal filter 656 is taken out from the clean air takeout port 664. Further, it is needed for all the constituents of the air flow paths and the storehouse existing downstream the clean air takeout port 664 to be made of materials that generate no gaseous impurities. Still further, every joint portion in the air flow paths and the storehouse, which require strict sealing, has to be sealed by using the fluororesin packing that generates no gaseous impurities. In the storage air generator 36' as shown in FIG. 6, the pressure drop across the particulate air filter 658 is monitored by the pressure gauge 666. Accordingly, it can be determined referring to the monitored pressure drop when the particulate air filter 658 is to be replace.

Figure 11:
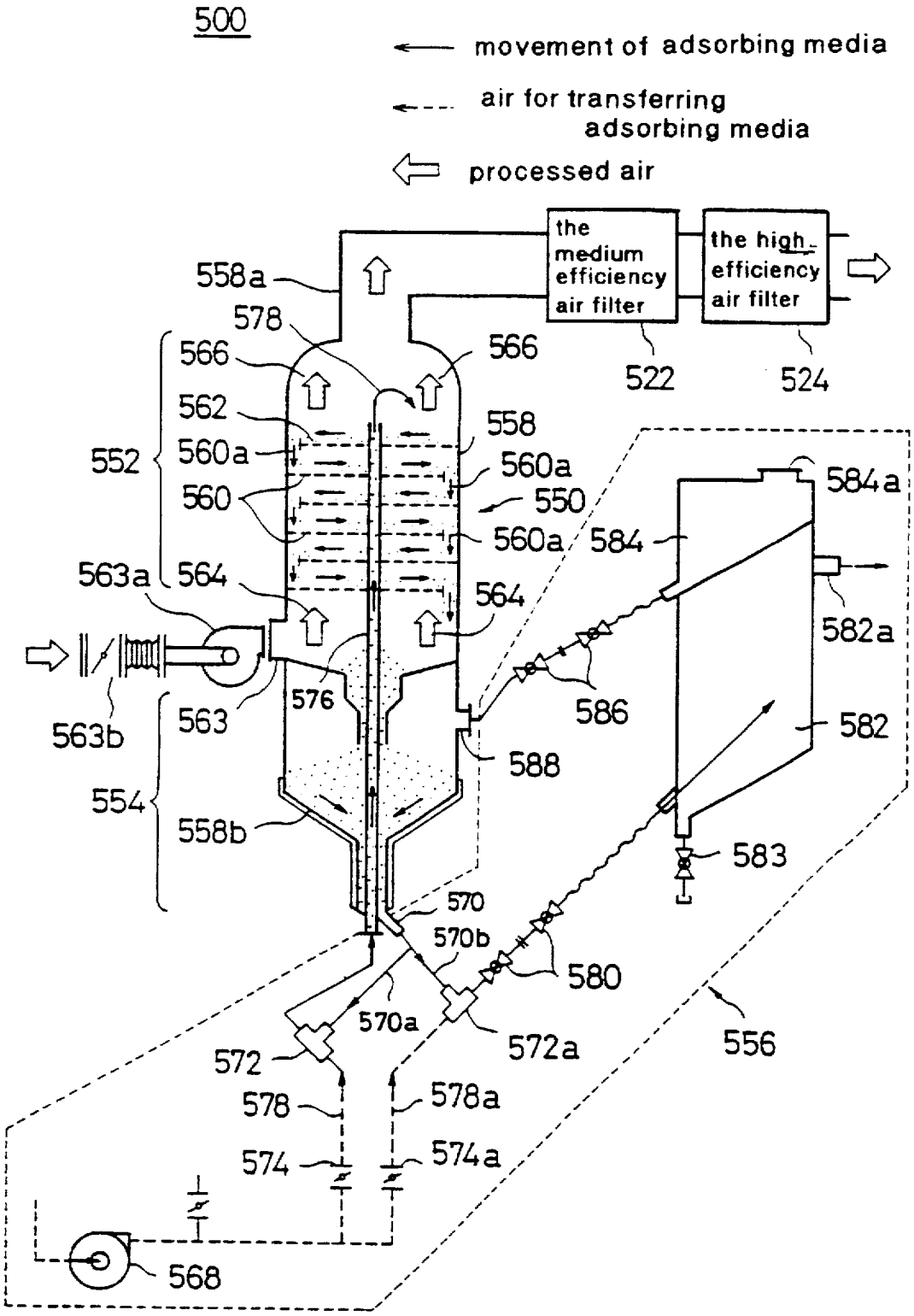
FIG. 11 is an illustration showing the constitution of another exemplary generator of the clean air for storage suitably applicable to the storehouse as shown in FIG. 1.

In the example of the air cleaner as shown in FIGS. 6 through 10, the activated charcoal filter is employed for adsorbing the hydrocarbon group in the air, but the present invention should not be limited by such example. The present invention is applicable to a system for processing gaseous impurities 500, as shown in FIG. 11, which is provided with a fluid bed adsorbing tower 550 using activated charcoal as filtering media. The system 500 comprises the fluid bed adsorbing tower 550, a medium efficiency air filter 522, and a high efficiency air filter 524, said both air filters being formed of materials generating no gaseous impurities and connected in series in this order with the adsorbing tower 550 at the downstream side thereof. At the time of installing these air filters, it is preferable for joint portions to be sealed with a sealing member generating no organic gas for instance a packing made of an inorganic material or fluororesin.

Broadly speaking, this fluid bed adsorbing tower 550 is divided into three portions i.e. a fluid bed adsorbing portion 552, a sealing portion 554, and a adsorbent transfer portion 556. The fluid bed adsorbing portion 552 includes a plurality of perforated plates 560 which are multi-stacked in the adsorbing tower 558. In the fluid bed adsorbing portion 552, the adsorbent or adsorbing media (e.g. granular activated charcoal) forms on respective multi-stacked perforated plates 560 a fluid bed 562 which has a height of 10 to 20 mm under the static condition while it has a height of 20 to 40 mm under the dynamic condition. The fluid bed travels from one perforated plate to the other in the direction of its flowing down, sequentially dropping from one to the other through respective flow-down portions 560a thereof. During this process, the adsorbent is made to uniformly get in touch with the air to be treated 564, which is taken into the tower to be supplied toward its upper portion through an air intake port 563, a damper 563b, and a volute blower 563a, thereby adsorbing gaseous components in said air to be treated. On the other hand, the cleaned air 566 is discharged out of the top portion 558a of the adsorbing tower 558. The adsorbent having arrived at the adsorbing tower bottom 558b forming the seal portion 554 is transferred back to the top stage of the adsorbing tower by the adsorbent transfer portion 556 and again participates in the process of adsorbing gaseous impurities.

Apparatus for removing gaseous impurities making use of the fluid bed adsorbing tower 550 has the advantage that it shows a very low draft loss because the air to be processed flows the adsorbent layer under the fluidized condition. For instance, when the air to be processed passes at a speed of 1 m/s through the fluid bed formed of the activated charcoal particles of 0.7 mm diameter and having the static height of 1.5 cm, the draft loss is only 10 mm H2O. In order to reduce the gaseous organic impurity concentration of ppm order in the air to less than 1 ppb, there would be needed only 7 fluid beds at most. That is, in terms of the draft loss, it would be enough if the draft loss of 70 mm H2O is anticipated in the design of the apparatus. During long continuous operation, the adsorbent in the adsorbing tower adsorbs impurities and approaches its breakthrough state i.e. the state where the adsorbent loses its adsorption ability due to impurity saturation therein. Accordingly, it is needed for earlier replacement of the adsorbent to be taken well before occurrence of such breakthrough. For instance, if the life time is 2 years long before the breakthrough occurs, it would be safe to renew the adsorbent every half a year.

Next, the adsorbent transfer portion 556 as shown in FIG. 11 will be explained in the following. The adsorbent transfer portion 556 is provided with a turbofan 568, by which the compressed air 578 is supplied to the top portion of the adsorbing tower via a damper 574, a three way pipe 572, and an air flowing pipe 576. The compressed air and the adsorbent coming from its takeout port 570 are mixed at the three way pipe 572. The adsorbent from the takeout port 570 can be taken out through two routes i.e. the first route 570a and the second route 570b. The adsorbent taken out via the first route 570a is carried away up to the top of the adsorbing tower by the compressed air 578. At this stage, the second route 570b is closed by closing the damper 574a and a valve 580.

On one hand, for replacing the adsorbent, the volute blower 563a is first stopped and the first route 570a is closed by shutting the damper 574. Contrary to this, the second route 570b is made open, and the compressed air 578a passing through the damper 574a is mixed with the adsorbent taken out from the takeout port 570 at the three way pipe 572a. This adsorbent is carried away by the compressed air, via the valve 580, to an adsorbent reservoir 582 for storing the used or saturated adsorbent. The compressed air 578a used for carrying the used adsorbent is discharged from a discharge port 582a provided at the reservoir 582.

After the used adsorbent in the adsorbing tower 558 is entirely transferred to the reservoir 582, the used adsorbent is taken out from the reservoir by opening a valve 583 provided at the lower portion of the reservoir. On the other hand, the fresh adsorbent is supplied to another reservoir 584 through the adsorbent supply port 584*a*. Then, the fresh adsorbent is supplied to the adsorbing tower 558 via a valve 586 and a fresh adsorbent receiving port 588.

In the fluid bed adsorbing tower 550 as described above, it might possibly happens that the flowing adsorbent per se serves as a sort of particulate generation source, if nothing is done. However, in the above embodiment of the present invention, the medium efficiency air filter 522 and the high efficiency air filter 524, both generating no gaseous impurities, are provided at the downstream side of the fluid bed adsorbing tower 550, so that it is possible to supply the clean air including neither gaseous impurities nor particulates to the downstream side. These medium and high efficiency air filters will be described in detail later. In FIG. 11, the medium and high efficiency air filters 522, 524 are connected with the adsorbing tower in series in that order, but it maybe possible to set up only the high efficiency air filter 524. However, in the fluid bed adsorbing tower 550, the adsorbing media in the flowing state is strongly rubbing each other, so that particulates sized in the micron order would be generated therefrom. Consequently, if these particulates are filtered by using the HEPA filter or the ULPA filter only, they would be soon clogged or materially sealed by such particulates. For instance, if such a high efficiency air filter is used against the air having a particulate concentration of 1 mg per cubic meter and flowing at a speed 0.3 m/sec, it would be clogged within about 2 months.

Accordingly, as is done in the above-mentioned embodiment of the present invention, it is preferable to first remove the particulates of the micron size which results from the mutual rubbing of the adsorbing media, by the medium efficiency air filter 522 and then to finally remove the particulates of the sub-micron size which have penetrated through the medium efficiency air filter 522, by the high efficiency air filter 524. It would be possible for the medium efficiency air filter 522 to be provided with such a means for recovering the filtration efficiency as is generally used in a bag filter, thereby extending its life time. In case of installing these medium and high efficiency air filters to the system, it is preferable to use a sealing member generating no organic gas, for instance a packing made of an inorganic material or fluororesin.

In the next, the operation of the storehouse as constituted in the above will be described referring to FIGS. 1 through 3.

It is firstly described how clean materials are carried in the storehouse. The carrier 26 containing a plurality of LCD substrates 18 to be stored is mounted on the carrier stand 24 in the clean room 12. Then, the partition wall 14 separating the front room 16 from the clean room 12 is opened, and the carrier 26 is carried in the front room 16 with the help of the transfer arm 28 and is placed on the carrier stand 30 provided in the front room 16. After this, the partition wall 14 is closed to separate the front room 16 from the clean room 12. Then, the storage air generator 36 (36') starts supplying the clean air into the front room 16 through the air supply system 32. At this stage, the clean air supplied to the front room 16 has been already processed and controlled such that it includes neither hazardous particulates nor a hydrocarbon group including methane of more than 10 ppb in total, or that the contact angle of a pure water droplet dropped on or the surface resistivity of the material surface is kept much the same as that which is shown immediately after rinsing it. At this time, the front room 16 forms a space isolated from the adjacent rooms (i.e. the partition wall 38 is closed to separate the front room 16 from the transfer room 20), so that the same volume of the air as supplied thereto is exhausted through the exhaust system 34. After the atmosphere in the front room 16 is sufficiently replaced by said clean air, the partition wall 38 between the front room 16 and the transfer room 20 is opened, and the carrier 26 is taken out and carried in the transfer room 20 from the front room 16 with the help of the transfer arm 40 of the transfer mechanism. In the next place, the movable stand 39 brings the carrier 26 up to the position of a vacant stocker 42 in the storage room 22 and then puts it therein. The clean air is supplied to the stoker 42 through the air supply system 46. Thus, there is formed an air flow as shown by an arrow in FIG. 3, which enters in the space 51 below stocker 42 via the carrier 26 and the transfer room 20. At this time, the storage room 22 and the transfer room 20 are isolated from the adjacent room (i.e. the partition wall 38 between the transfer room 20 and the front room 16 is closed), so that the same volume of the air as supplied thereto is exhausted through the exhaust system 50.

Next, it will be explained how the carrier 26 is carried out from the stocker 42 after it stays there for a predetermined period of time. The movable stand 39 moves toward the stocker 42 in which the carrier 26 rests, and then holds and takes the carrier 26 out of the stocker 42 by using the transfer arm 40. Then, the movable stand 39 moves back to the front room 16. At this stage, the front room 16 is made airtight and its inside is kept in the clean air atmosphere. After the partition wall 38 is opened, the transfer arm 40 unloads the carrier 26 from the movable stand 39 to the carrier stand 30 in the front room 16. After this, the partition wall 38 between the transfer room 20 and the front room 16 is closed while the partition wall 14 between the front room 16 and the clean room 12 is opened. Then, the carrier 26 on the carrier stand 30 is finally transferred to the carrier stand 24 in the clean room 12 by using the transfer arm 28.

Figure 12:
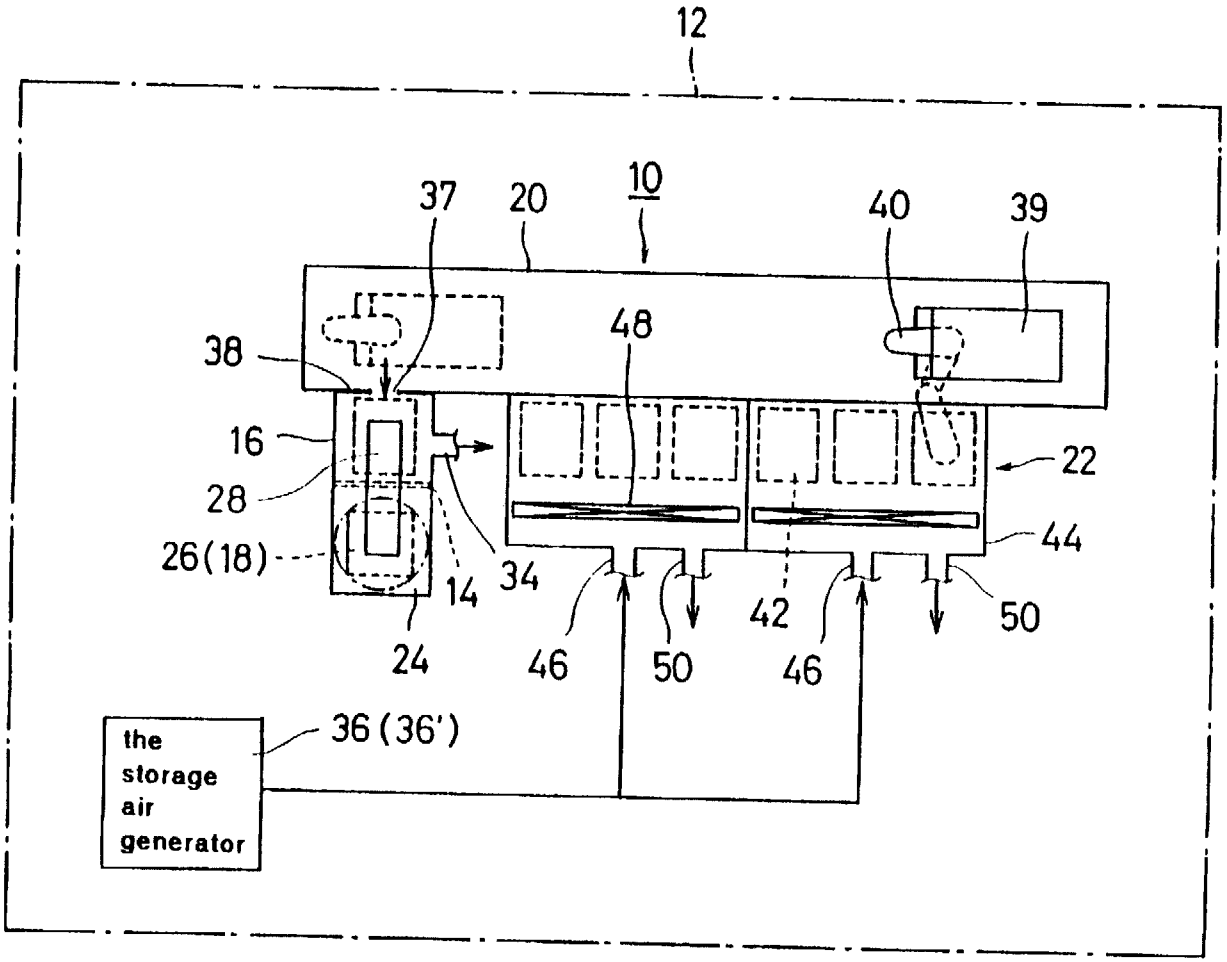
FIG. 12 is a schematic plan view showing another exemplary storehouse for the clean material, embodying the present invention.

In the embodiment as shown in FIGS. 1 through 4, the air supply to the front room 16 is carried out by the air supply system 32. However, as shown in FIG. 12, it may be possible to constitute the storehouse wherein the air supply system 32 is eliminated. Instead, an opening portion 37 can be provided penetrating through the partition wall 38 separating the front room 16 from the transfer room 20 (storage space), thereby a part of the clean air supplied to the storage room 22 being allowed to flow into the front room 16 through the transfer room 20. According to this constitution, the clean air is always made to flow from the storage room 22 to the front room 16 via the transfer room 20, so that the contaminant can be effectively blocked to the front room 16 via the transfer room 20, so that the contaminant can be effectively blocked not to enter the storage room 22, even though it is generated in the front room 16 and transfer room 20 as well. In this case, in order to remove the particulates which are possibly generated on the way from the air supply system 46 to the storage room 22, it is also possible to provide the particulate air filter 48 formed of materials generating no gaseous impurities.

Figure 13:
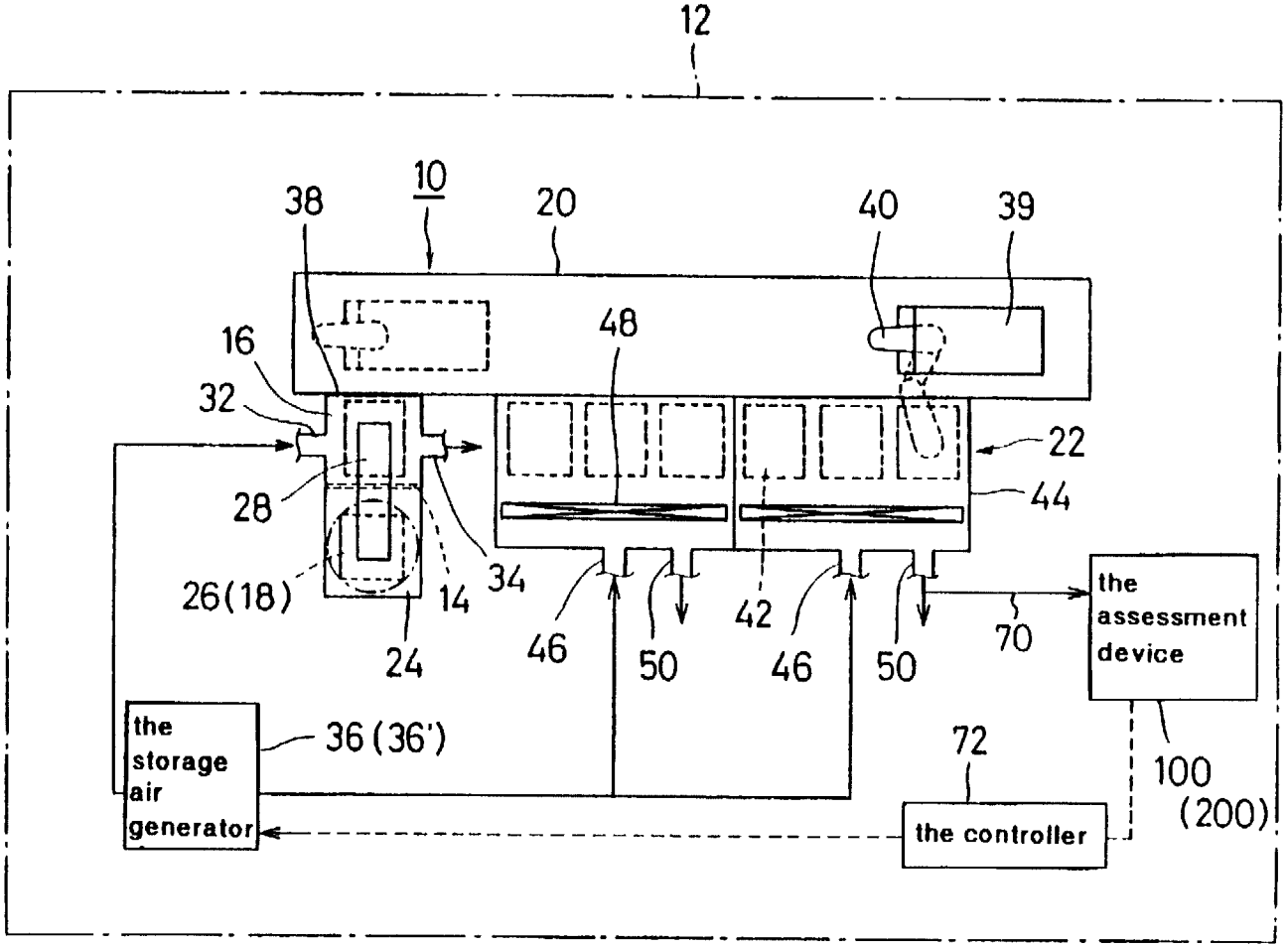
FIG. 13 is a schematic plan view showing still another exemplary storehouse for the clean material, embodying the present invention.

FIG. 13 shows another embodiment of the storehouse according to the present invention. According to this embodiment, the storehouse as described referring to FIGS. 1 through 4 further includes a device assessment 100(200) for carrying out the assessment over the degree of contamination caused by organic substances in the storage room 22 (or transfer room 20, front room 16). In the present description, the constituents of the present invention having the like function are denoted with the like reference numerals through the all accompanying drawings, and the explanation there about will not be repeated.

Figure 14:
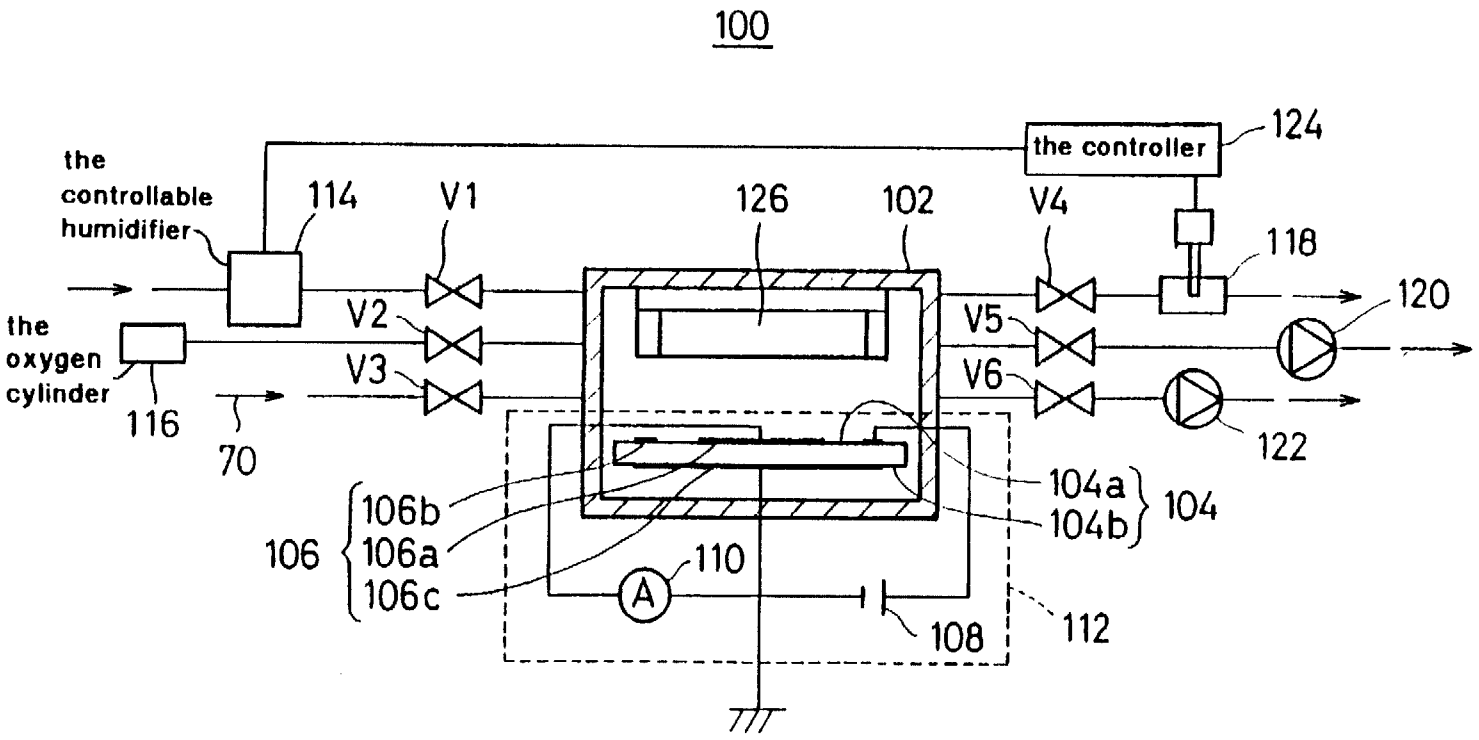
FIG. 14 is a schematic illustration showing an assessment device applicable to the storehouse for the clean material according to the present invention.
Figure 17:
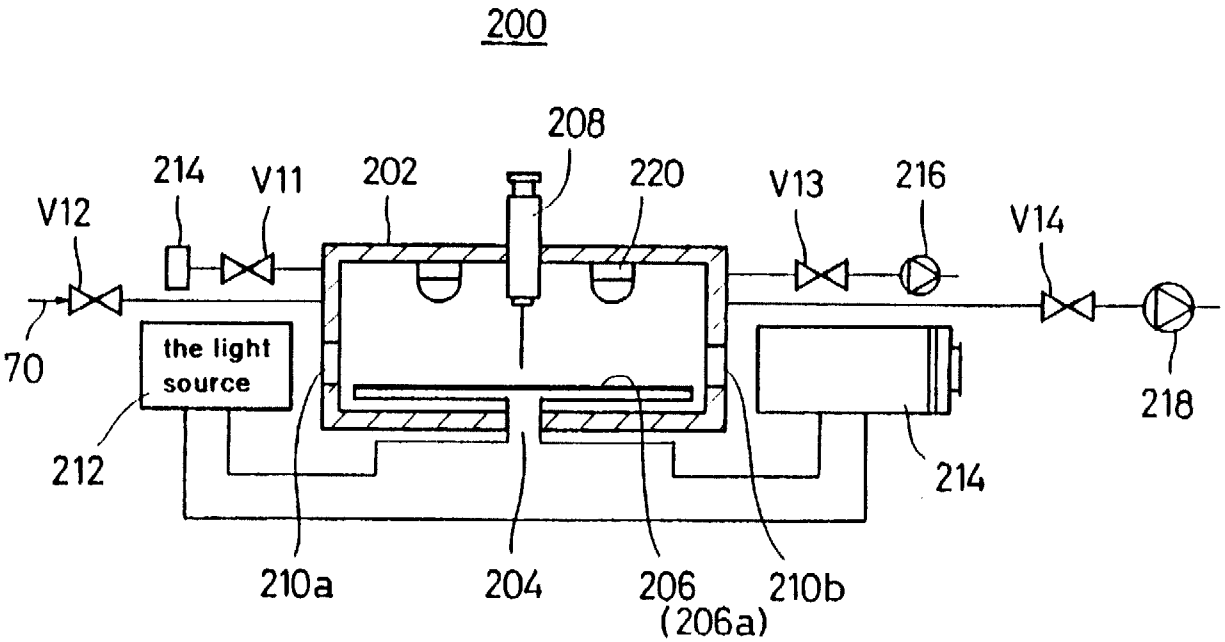
FIG. 17 is a schematic illustration showing another assessment device applicable to the storehouse for the clean material according to the present invention.
Figure 20:
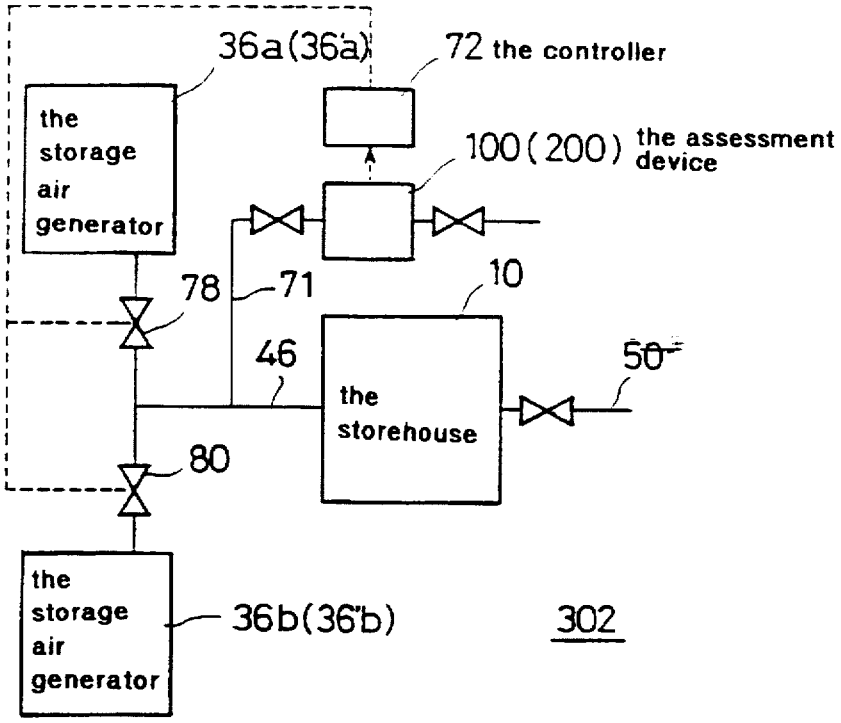
FIG. 20 is a schematic illustration showing the constitution of a backup mechanism applicable to the storehouse for the clean material according to the present invention.
Figure 21:
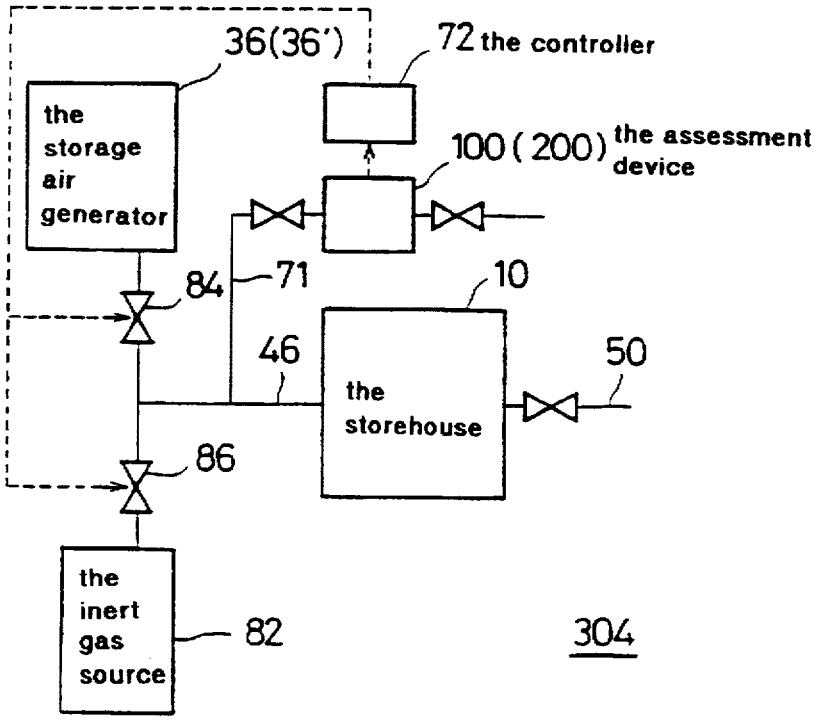
FIG. 21 is a schematic illustration showing the constitution of another backup mechanism applicable to the storehouse for the clean material according to the present invention

As shown in FIG. 13, this assessment device 100(200) is provided with a chamber 102(202) constituting the second locally defined space as shown in FIGS. 14 and 17, which is spatially isolated from the clean environmental space (clean room) 12 as well as from the storage space (first local clean space) consisting of the front room 16, the transfer room 20, and the storage room 22. However, a pipeline 70 is provided for allowing the clean air for storage in the storage room 22 to be supplied to this chamber 102(202). The result obtained by the assessment device 100(200) is transmitted to a controller 72, which can order the storage air generator 36(36'), for instance to interrupt the air supply depending on the assessment result. In case that a backup device which is shown in FIGS. 20 and 21 and will be described later, is employed, this controller 72 can also send a predetermined command to the backup device. In the embodiment as shown in FIG. 13, the pipeline 70 which is used for introducing the atmosphere to be assessed to the assessment device 100 (200), is constituted as a pipeline branching off the exhaust system 50. However, it is possible for a pipeline 71 to be provided so as to branch off the air supply system 46 of the storage air generator 36(36') as shown in FIGS. 20 and 21.

The assessment device may employ any assessment method if it can assess the degree of organic contamination in the storage space (i.e. front, transfer, and storage rooms) 16, 20, 22. For instance, it is possible to employ the device which can measure the amount of the organic substance deposited on the substrate surface by the method of X-ray Photoelectron Spectroscopy (referred to as just XPS method hereinafter). According to this XPS method, the element existing on a sample substrate surface can be qualitatively and/or quantitatively analyzed and determined through the steps of irradiating the sample surface with soft X-rays under the high vacuum condition, and measuring the energy and number of electrons driven out of the sample surface by using a spectrometer. In the assessment of extremely low surface contamination by the organic substance according to this XPS method, the contamination quantity is represented by a ratio of the number of carbon to the total elements existing in a region extending to the depth of several tens angstroms from the surface, or a ratio of the number of carbon to the known number of total elements existing in said region. The measurement by the XPS method is carried out by the following steps, that is, inserting a substrate having an insulating surface in a chamber for exposing it to the atmosphere in the storage space, evacuating the chamber at a constant interval and assessing the contamination quantity of the substrate surface. By repeating these steps, the contamination degree of the atmosphere in the storage space can be determined by monitoring the change of the contamination quantity with time. Further, with employment of such assessment apparatus, it becomes possible to solve the issue relating to the replacement timing of the activated charcoal filter, which has been controverted but left unclear so far, and to explicitly know the deterioration of the activated charcoal filter.

Figure 18:
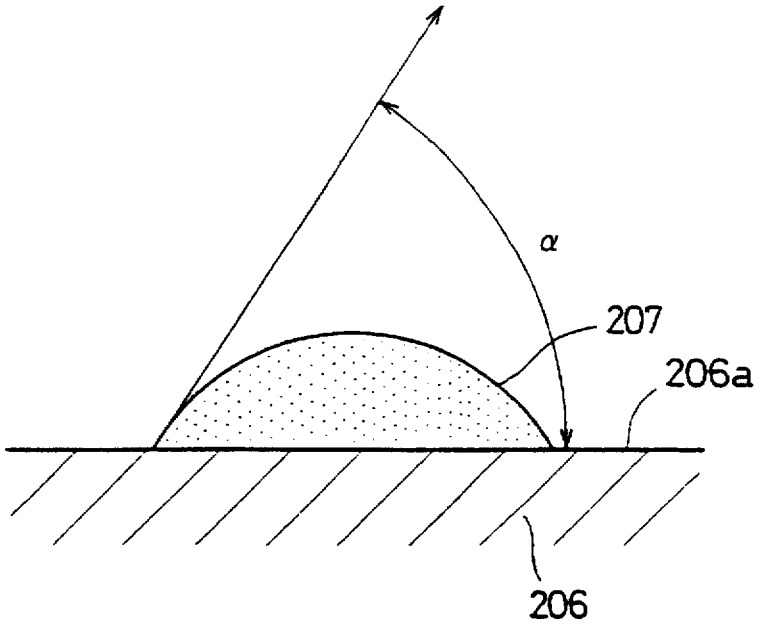
FIG. 18 is an illustration for explaining the relationship between the water droplet dropped on the substrate surface and a contact angle formed thereby.
Figure 19:
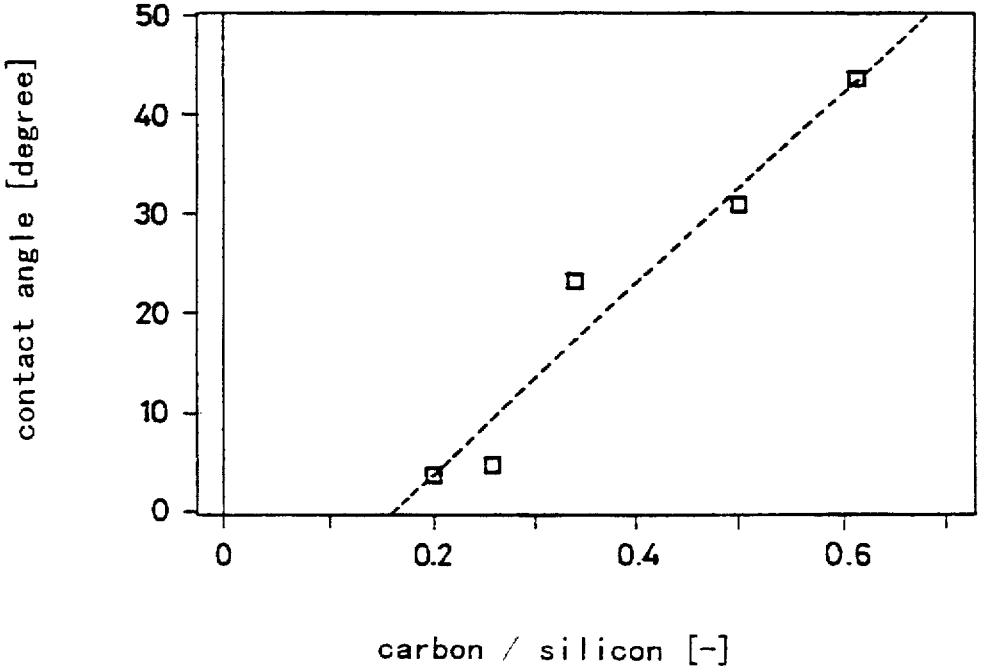
FIG. 19 is a graph showing the relationship between the contact angle and the quantity (ratio of carbon/silicon) of organic substances deposited on the glass substrate surface.

The assessment apparatus using the XPS method can perform the accurate measurement of the organic substance quantity, so that it is a very much effective means for assessing the atmosphere which would cause the organic contamination on the glass substrate surface stored in the storage room. However, it is inevitable for the apparatus to be equipped with a high vacuum system and a spectrometer, which are so expensive. At the same time, this XPS method is not always suitable when it is desired that the sampling and analysis of the atmosphere can be performed at the same place, in other words, when a so-called "in-line analysis" is so desirous or absolutely needed. As will be described herein, however, there can be provided more inexpensive assessment devices allowing the precise measurement and in-line analysis, namely one being an assessment device 100 as shown in FIGS. 14 to 16, which make use of the change in the surface resistivity of an insulting substrate surface, caused by exposure to a certain atmosphere, and the other being the assessment device 200 as shown in FIGS. 17 to 19 which makes use of the change in the contact angle of a water droplet which is dropped on the surface of the conductive or insulating substrate surface, resulting from exposure to a certain atmosphere.

Figure 15B:
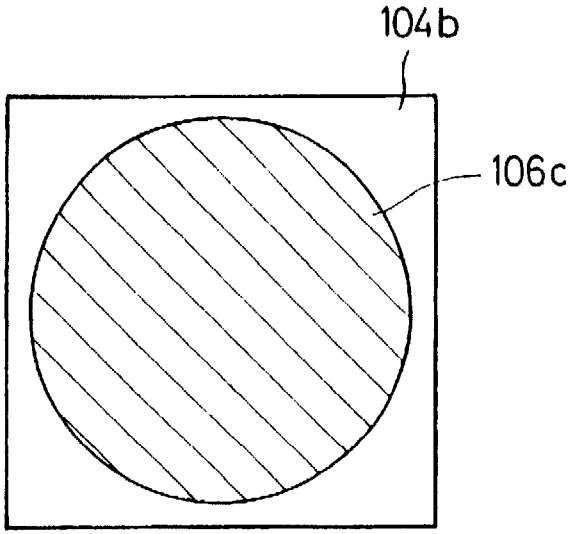
FIG. 15 is a plan view of an electrode formed on a substrate for use in assessment by the assessment device as shown in FIG. 14: (A) shows a front surface while (B) shows a back surface.
Figure 15A:
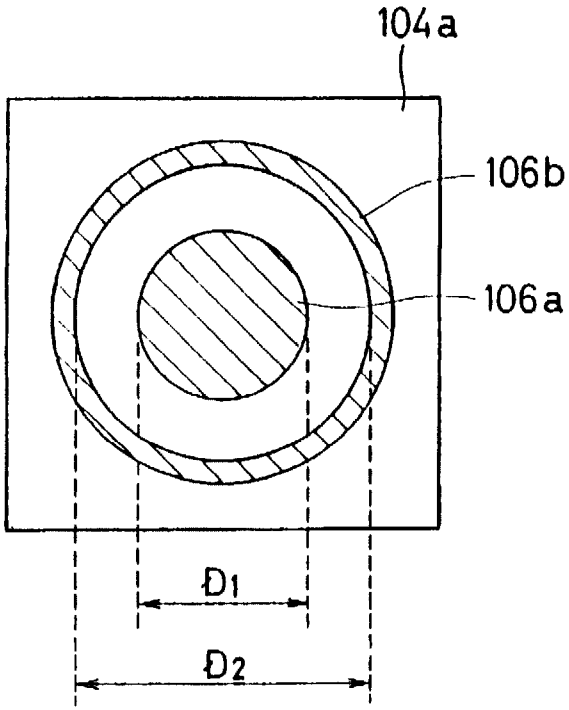
Figure 16:
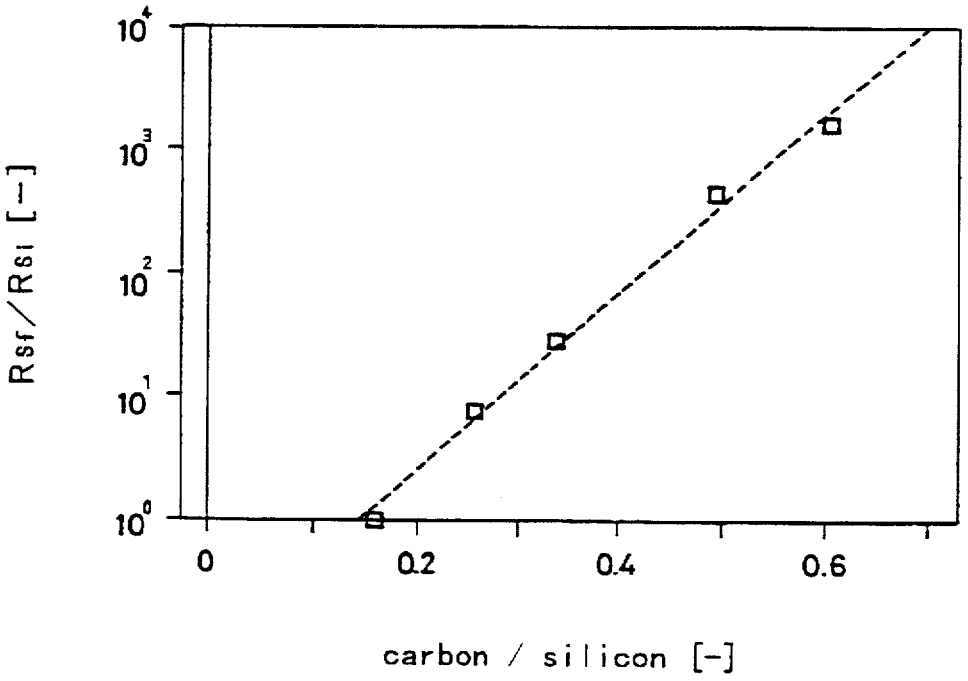
FIG. 16 is a graph showing the relationship between the quantity (ratio of carbon/silicon) of organic substances deposited on the glass substrate surface and the increase ratio(Rsf/Rsi) of the surface resistivity.

The assessment device 100 will be firstly described referring to FIGS. 14 to 16.

As shown in FIG. 14, the assessment device 100 is provided with an isolated space 102 which is isolated from the first local space and the environmental clean space as well. This isolated space102 can be constructed as a chamber which is isolated from the environmental space by means of partition walls made of aluminum, for instance. Inside of this isolated space 102 is placed a glass substrate 104 having a clean surface **104*a* from which surface organic substances have been removed. In the present embodiment, the glass substrate 18 is stored in the storage room 22, so that the glass substrate is employed as the objective sample to be assessed. However, if silicon wafers are stored in the storage room 22**, the silicon wafer should be adopted as the objective sample to be assessed. Like this, the precise assessment can be realized by using the substrate having the surface made of the same material as those which are stored in the storehouse, as the objective sample to be assessed. Furthermore, it is preferable that the exposure time of the substrate to the atmosphere to be assessed or monitored after cleaning it, is made identical to that of the substrate to be stored in the storage space after cleaning it. In the present embodiment, the substrate surface is needed to be insulating, so that in the case of the silicon wafers, they should be provided with an oxide film or layer on their surface.

The glass substrate 104 is provided with a metal electrode 106 which is formed on the substrate surface by vapor deposition, for use in measurement of the surface resistivity. FIGS. 15(A), (B) are a schematic illustration of the metal electrode 106. As shown in the figures, the metal electrode 106 consists of the first electrode **106*a* which is formed by vapor deposition about at the center of the surface 104*a* of the substrate 104, having an about circular shape with a diameter of D1, the annular shaped second electrode 106*b*, having an inner diameter D2, which is coaxially disposed with regard to the first electrode 106*a*, and a ground electrode 106*c* of an about circular shape which is formed on the back surface 104*b* of the glass substrate 104 by vapor deposition. These electrodes 106*a*, 106*b*, 106*c* can be formed by directly depositing a conductive material on the surfaces 104*a*, 104*b* of the glass substrate 104. Alternatively, these electrode 106*a*, 106*b*, 106*c* can be formed by first making an insulating film using the plasma CVD method and then depositing a conductive material by using the sputtering system. A power source 108 and ammeter 110 are connected in series between the first and second electrodes 106*a*, 106*b*, thereby establishing a surface resistivity meter 112. In the example as illustrated in the figure, for easy understanding, the surface resistivity meter 112 is constituted including a part of the isolated space 102. However, this should not limit the invention, and the surface resistivity meter 112 may be replaced by any device capable of measuring the electric resistance at least between two points on the surface of a sample substrate 104, thus various kinds of the surface resistivity meters being usable. Furthermore, in the present embodiment, a glass substrate is adopted as a sample substrate 104 just for an example. Accordingly, depending on the object to be measured, it is also possible to use a different sample substrate. For instance, there can be used for surface resistivity measurement, a silicon wafer covered with an insulating film and having the measurement electrode 106** formed thereon.

The isolated space 102 is connected via an intake valve V1 with a controllable humidifier 114 to be supplied with the pressurized clean air with controlled humidity. It is further connected via another intake valve V2 with an oxygen cylinder 116 for introducing oxygen therein. It is still further connected with another intake valve V3 for introducing the atmosphere to be assessed. The isolated space 102 is connected with exhaust valves V4, V5, and V6, respectively, the valve V4 communicating with a humidity sensor 118, the valve V5 doing with an exhaust pump 120, and the valve V6 doing with an air pump 122. The relative humidity detected by the humidity sensor 118 is transmitted at a predetermined interval to a controller 124, which in turn feeds this information to the humidifier 114 to control it. The isolated space 102 includes an ultraviolet lamp 220 which is installed on the upper part thereof and is used for irradiating the surface 104*a* of the substrate 104.

For measuring the surface resistivity of the glass substrate immediately after completion of cleaning it, valves V2, V5, V3, and V6 are respectively closed while valves V1 and V4 are opened, thereby introducing the pressurized gas as controlled to have a predetermined relative humidity into the isolated space 102. This pressurized gas having a controlled relative humidity can be obtained by supplying the pressurized air to the humidifier 114 i.e. so-called the flow distribution method. In order to maintain the constant relative humidity in the isolated space 102, the distribution amount to the humidifier 114 receives the feedback control by the humidity sensor 118 and the controller 124, both of which are provided at the egress side of the humidity controlled gas. The relative humidity in the isolated space 102 having reached a predetermined level, the voltage is applied to the measurement electrode 106 to measure an initial surface resistivity (RSI of) the clean glass substrate by the surface resistivity meter 112.

After this measurement procedure, the valves V1 and V4 are closed while the valves V3 and V6 are opened to guide the atmosphere to be assessed into the isolated space 102 by the air pump 122 and to have the surface 104*a* of the glass substrate 104 exposed to said atmosphere for a predetermined period of time. The exposure time having lapsed, the valves V3 and V6 are closed while the valves V1 and V4 are opened, thereby recovering the predetermined relative humidity (substantially the same as that which is used for measuring said initial surface resistivity) in the isolated space 102 by the controller 124. Said predetermined relative humidity having been recovered, the surface resistivity (Rsf) is measured by the surface resistivity meter 112. In this way, the change with time in the organic contaminant quantity can be pursued by repeating the measurement of the surface resistivity (Rsf) at a constant interval.

As described in the above, the isolated space 102 is provided with an ultraviolet (UV) lamp 126. Therefore, one round of the surface resistivity measurement being over, the pressurized oxygen gas is introduce to the isolated space 102 by closing valves V1, V4, V3, and V6, and opening the valves V2 and V5, and at the same time, the surface 104a of the glass substrate 104 is cleaned by so-called UV/ozone cleaning in which the UV lamp irradiates the surface 104*a* to decompose the organic substances deposited thereon. After UV/ozone cleaning, the valve V2 is closed while the valves V1 is opened leaving the valve V5 open, and then the ozone gas generated during the UV/ozone cleaning procedure is exhausted by the exhaust pump 120 to replace the inside of the isolated space 102 with a purified air. In this way, the isolated space is prepared for the next measurement of change with time in the surface resistivity.

Through the above measurement, it has been found that there is a correlation as shown in FIG. 16, between the quantity (carbon/silicon ratio) of organic substances deposited on the glass, which is measured by the XPS method, and the increase ratio (Rsf/Rsi) in the surface resistivity, which is measured in the atmosphere having a predetermined relative humidity. As shown by the graph, the surface resistivity is increased along with the increase of the quantity of the deposited organic substances, so that the increase ratio of the surface resistivity can be converted into the quantity of the deposited organic substances by making use of this correlation. For instance, from the different increase ratios of the surface resistivity which will be obtained by exposing the glass substrate to various kinds of atmospheres for a constant period of time, it would become possible to know in comparison how much ill influence they would give as a contamination source. Also, if the surface resistivity of the same substrate which is placed in a specific atmosphere, is repeatedly measured at a constant interval, it would become possible to continuously monitor whether or not the quantity of the organic substances deposited on the glass substrate from the specific atmosphere is below the allowable level.

In the next, the assessment device 200 will be explained referring to FIGS. 17 to 19. This device utilizes the contact angle between the substrate surface and the water droplet as dropped thereon.

As shown in FIG. 17, the assessment device 200 is provided with an isolated space 202 which is isolated from the first local space and the environment atmosphere as well. For instance, this isolated space 202 can be constructed as a chamber which is isolated from the environment with partition walls made of aluminum, for instance. As shown in FIG. 18, there is provided inside the isolated space 202 a stage 204 on which a glass substrate 206 is mounted. The surface 206*a* of this substrate 206 is made free from the organic substance by cleaning in advance. Above the glass substrate 206 is located a syringe 208 which is used for dropping an ultra-pure water droplet onto the glass substrate surface 206*a*. As shown in FIG. 17, the stage 204 is installed on a mechanism (not shown) which can horizontally and/or rotatively move the stage 204 in a horizontal plane, so that the placement of the water droplet 207 dropped from the syringe 208 can be freely changed. In the present embodiment, the glass substrate 18 is stored in the storage room 22, so that the glass substrate is employed as the objective sample to be assessed. However, if silicon wafers are stored in the storage room 22, the silicon wafer should preferably be adopted as the objective sample to be assessed. Like this, the precise assessment can be achieved by using the substrate which has the same surface material as those which are stored in the storehouse, as the objective sample to be assessed. Also in the present embodiment, different from the case as shown in FIG. 14, there is no need for the substrate surface to be insulated, so that the silicon substrate can be used as it is, without any preliminary treatment such as formation of the oxide film.

Furthermore, the opposing side walls of the isolated space 202 include one each of observation windows 210*a* and 210*b*, respectively. Outside the window 210*a* is arranged a light source 212 for lighting up the water droplet 207 dropped on the substrate 206 while a means for enlarging an image 214 such as a microscope or a magnifying glass is disposed outside the window 210*b*, for observing the water droplet 207 thereunder. Thus, as shown in FIG. 18, the water droplet 207 as dropped on the glass substrate 206 can be observed under the light from the light source 212 with the help of the magnifying glass 214. The assessment of the degree of the organic contamination based on the change in the contact angle a is performed according to the following principle. The surface of the substrate with no organic contaminant, for instance a clean silicon substrate with an oxide film or a clean glass substrate, is well wet with water i.e. of hydrophilicity, so that the contact angle becomes smaller. On the other hand, once the organic contamination occurs on the substrate surface, the surface nature is changed from hydrophilicity to hydrophobicity, thereby coming to shed water well and the contact angle becoming larger, accordingly. Therefore, the degree of the organic contamination can be assessed by observing the change with time in the contact angle with the help of the device as shown in FIG. 17.

The isolated space 202 can be supplied with a cleaning gas including at least oxygen through an intake valve V11 from a cylinder 214, and also with the gas to be assessed through another intake valve V12. The isolated space 202 is further connected through an exhaust valve V13 with an intake/exhaust pump 216 to exhaust the cleaning gas and is still further connected through another exhaust valve V14 with an air pump 218 for exhausting the gas to be assessed. On the upper part of the isolated space 202 is installed a UV lamp 220 for use in irradiating the surface 206*a* of the substrate 206 for cleaning it.

Now, it will be described in the following how the degree of the organic contamination occurring on the substrate surface is assessed by using the above-mentioned assessment device. At first, the contact angle is measured by the magnifying glass 214 with respect to the substrate immediately after cleaning it. After this, valves V11 and V13 are closed while valves V12 and V14 are opened to supply the objective atmosphere to be assessed to the isolated space 202 by operating the air pump 218. After exposing the surface 206*a* of the substrate 206 to said objective atmosphere for a predetermined period of time, the stage 204 is driven to move the substrate 206 in the horizontal plane inside the isolated space 202. In the present embodiment, the device is so constituted that the stage 204 is driven, but it may be possible to constitute it such that the syringe 208 is driven while the substrate 206 (i.e. stage 204) immovably stays. In other words, the stage 204 or the substrate 208 is rotated or horizontally moved at every finish of the contact angle measurement, and another water droplet is dropped on the substrate surface which has never experienced any water droplet as yet for another contact angle measurement. In this way, the change with time in the organic contamination quantity can be pursued by repeating the above mentioned measurement at a constant interval.

A series of the contact angle measurements being over, both valves V12 and V14 are closed while both valves V11 and V13 are opened to supply the cleaning gas including at least oxygen to the isolated space 202 from the cylinder 214, and at the same time, the surface 206*a* of the glass substrate 206 is cleaned by so-called UV/ozone cleaning in which the UV lamp 220 irradiates the surface 206*a* to decompose the organic substances deposited thereon. After the UV/ozone cleaning, the valve V11 is closed while the valves V12 is opened leaving the valve V13 open, and then the ozone gas generated during the UV/ozone cleaning procedure is exhausted by the exhaust pump 216 to replace the inside of the isolated 202 with the objective atmosphere to be assessed. In this way, the isolated space is prepared for the next measurement of change with time in the contact angle.

FIG. 19 is a graph showing the correlation between the quantity (carbon/silicon ratio) of the deposited organic substances and the contact angle. As shown in the figure, the contact angle is increased corresponding to the increase of the quantity (carbon/silicon ratio) of the deposited organic substances, so that the measurement value of the contact angle can be converted into the quantity of the deposited organic substances by making use of the correlation as indicated in the graph. For instance, based on the different increase ratios of the contact angle which will be attained when exposing the glass substrate to various kinds of atmospheres for a constant period of time, it would become possible to know in comparison how much ill influence they would give as a contamination source. Also, if the contact angle is repeatedly measured at a constant interval regarding the same substrate which is placed in a specific atmosphere, it would become possible to continuously monitor whether or not the quantity of the organic substances deposited on the glass substrate from said specific atmosphere is kept below the allowable level.

In the storehouse 10(10') as shown in FIGS. 1 to 4, as far as the storage air generator 36 using the method of combustion with a catalyst normally operates or the adsorbing performance of the activated charcoal filter as used in the storage air generator 36' is working still within its usable range, the increase in the surface resistivity as measured by the assessment device 100 as shown in FIG. 14 should be several percent per day while the increase in the contact angle measured by the assessment device 200 as shown in FIG. 17 should be several degrees per day. However, if the increase ratio of the surface resistivity and the contact angle as respectively measured by the assessment devices 100 and 200 exceeds the above mentioned range (for instance, several tens percent per day for the surface resistivity, several tens degree per day for the contact angle), it should be judged that some abnormal matters emerge in the storage air generator 36, and/or that the breakthrough occurs in the activated charcoal filter of the storage air generator 36' by which the organic substance in the objective atmosphere to be cleaned can be insufficiently removed, and/or that the organic contamination has been arisen in the storage space. In the event as such, all the clean materials as stored have to be newly cleaned and stored again. The controller 72 as shown in FIG. 13 would issue a command having the storage air generator 36(36') stopped supplying the air in order that the storage air generator 36(36') is to be repaired and/or that the activated charcoal filter is to be replaced. Alternatively, if a backup mechanism is provided as shown in FIGS. 20 and 21, the controller 72 would be able to switch the storage air generator in operation to the backup mechanism.

It is possible to employ a mechanism 302 shown in FIG. 20 as a backup mechanism. In this backup mechanism 302, the storage air generator 36(36') is constituted with two systems i.e. the first storage air generator 36*a*(36*a*') and the second storage air generator 36*b*(36*b*'), which are separately controllable. The clean air supplied to the storehouse 10 is supplied in part via a pipeline 71 branching off an air supply system 46, to the assessment device 100(200) in which the degree of the organic contamination is monitored with time. For instance, the clean air for storage being supplied from the first storage air generator 36*a*(36*a*') (valve 78: open; valve 80: closed) and the assessment device 100(200) having affirmed occurrence of the organic contamination, the controller 72 can operate to close the valve 78 and to open the valve 80 for switching the clean air supply source to the second storage air generator 36*b*(36*b*'). At this stage, the activated charcoal filter as used in the first storage air generator 36'*a*could be replaced, if it is really a cause for the abnormal state.

In FIG. 21, there is shown another embodiment of the backup mechanism. In this backup mechanism 304, a source for an inert gas supply source 82 is connected with the air supply system 46 instead of the second storage air generator 36*b*(36*b*') as shown in FIG. 20. Consequently, the assessment device 100(200) having affirmed occurrence of the abnormal condition, the controller 72 operates to close the valve 84 connected with the storage air generator 36(36') and to open the valve 86 connected with the inert gas supply source 82. Consequently, the inert gas is supplied to the storehouse 10 as a provisional countermeasure until the repair of the storage air generator is finished.

The present invention has been explained in detail with reference to the embodiments suitable for the storehouse for use in storage of the LCD substrate. Needless to say, however, the present invention should not be limited to those embodiments, and one skilled in the art will understand that various changes and modifications may be effected within category of technical concepts as recited in the claims, and may come under the technical scope of the present invention.

For instance, the present invention is applicable not only to the storehouse for storage of the LCD substrate, but applicable to the storehouse for storing the semiconductor substrate. Also, the present invention is applicable not only to the storage of the substrate on its carrier basis, but to the direct storage on the individual substrate basis. Furthermore, according to the present invention, the storage air generator is not limited to that which uses the method of combustion with a catalyst as shown in FIG. 5. It may be any apparatus if it can produce the clean air controlling the produced air such that it contains a hydrocarbon group including methane of less than 10 ppb. Still further, the present invention is limited neither to the storage air generator using the activated charcoal filter as shown in FIGS. 6 to 10, nor and that which is employing the fluid bed adsorbing tower using activated charcoal as absorbing media as shown in FIG. 11. Whatever apparatus may be used if it generates such clean air that the contact angle between the clean material surface and a pure water droplet or the surface resistivity of the clean material can be kept at much the same as that which is achieved and observed immediately after cleaning the material.

The present invention uses the device for directly assessing the degree of the organic contamination on the surface of the substrate stored in the storage space, which is shown in FIG. 14 and FIG. 17 as well. However, it is not limited by such a device. The present invention allows various kinds of sensors capable of indirectly assessing the organic contamination taking place on the substrate surface. For instance, the assessment device can be constituted by employing a sensor which can indirectly estimate the quantity of the organic contaminants on the substrate surface. Furthermore, in the embodiments as illustrated in the drawings, the storehouse is constructed inside the clean room. However, the requirement is that the storehouse is constructed such that it is isolated from the environmental clean atmosphere, thus it being possible to construct it outside the clean room.

As has been described in the above, the first isolated clean space is filled with the clean air which is controlled to contain a hydrocarbon group including methane of less than 10 ppb, thus enabling the substrate surface to be effectively protected from the organic contaminant. In that case, since no inert gas is utilized, the storehouse can be safely operated at a lower running cost.

Still further, the first isolated clean space for storing the clean material is filled with the clean air for storage which is produced through the catalyst reaction tower, the charcoal filter unit, or the absorbing tower of fluid bed type, and in which the contact angle between the substrate surface and the pure water droplet dropped thereon or the surface resistivity of the substrate surface is kept substantially unchanged i.e. the contact angle or the surface resistivity being kept at much the same level as that which is measured immediately after cleaning the material. Consequently, the substrate surface can be effectively protected from the organic contaminants. As no inert gas is adopted, the safety in the storehouse is ensured in its operation, and the initial cost for constituting the storehouse and the running cost would be largely reduced. Since at the downstream of the catalyst reaction tower, the activated charcoal filter unit, or the fluid bed type adsorbing tower, there can be provided means for removing particulates, which is made of the materials generating no impurity gas by themselves, thus reducing the quantity of the particulates and impurity gas contained in the purified air.

Furthermore, the first isolated space is divided into the storage space for storing the clean material and the buffer space, so that it is prevented that the organic substance contained in the atmosphere of the environment clean space enters in the atmosphere in the storage space to be mixed therewith, while the materials are transferred from or to the storage room. Accordingly, it is possible to construct the storehouse suitably and preferably storing the half-finished products which usually have to repeat "carrying in and carrying out" to the storage room so often.

If the degree of the surface organic contamination, which is caused by the clean air of the first local clean space against the clean materials stored therein, is always monitored with time in the second local clean space by the assessment device, an effective and immediate countermeasure can be taken well before the organic contamination is seriously developed in the first local clean space, thereby the materials as stored therein being so contaminated that the production yield is reduced badly.

What is claimed is:

1. A storehouse for use in the storage of a clean material comprising:

an environmental clean space being kept at a level of a first cleanliness;

a first local clean space which is isolated from said environmental clean space and is provided with a storage means for storing the clean material;

means for generating clean air for storage, said clean air for storage being controlled to have a second cleanliness level that it contains a hydrocarbon group including methane at less than 10 ppb; and means for supplying said clean air for storage to said first space.

2. A storehouse as claimed in claim 1, wherein said means for generating the clean air for storage is provided with means for removing said hydrocarbon group contained in outdoor air or the air in said environmental clean space by decomposing said hydrocarbon group using a method of combustion with a catalyst.

3. A storehouse as claimed in claim 1, wherein said first local clean space comprises a storage space in which said storage means is set up, and a buffer space intervening between said storage space and said environmental clean space, said storage space being isolated from said buffer space by a partition wall which can be opened and shut, and also said buffer space being isolated from said environmental space by means of the like partition wall.

4. A storehouse as claimed in claim 3, wherein said means for generating clean air for storage supplies the clean air for storage from said storage space to said buffer space.

5. A storehouse as claimed in claim 1, further comprising a second local clean space isolated from said first local clean space and said environmental clean space, a gas introducing means for introducing the clean air for storage from said first local clean space into said second local clean space, and an assessment device for assessing organic contamination caused by the clean air for storage.

6. A storehouse as claimed in claim 5, wherein said means for generating clean air for storage includes a plurality of air supply systems which are made independent from each other and can be switched from one to the other to supply said clean air for storage to said first local clean space in response to the assessment result attained by said assessment device.

7. A storehouse as claimed in claim 5 further comprising an inert gas supply means for supplying an inert gas to said first local clean space, and said means for generating clean air for storage is switched to said inert gas supply in response to the assessment result attained by said assessment device.

8. A storehouse as claimed in claim 5, wherein said assessment device includes a substrate at least the surface of which is insulated, a surface resistivity meter for measuring the electric resistance between at least two points on said substrate, means for introducing to said second local clean airspace a humidity controlled gas having a substantially constant relative humidity, and means for assessing the contamination occurring on said substrate in view of the surface resistivity measured by said surface resistivity meter and diagnosing the deterioration of the capability of removing organic substances in said means for generating the clean air for storage.

9. A storehouse as claimed in claim 8, wherein the quality of the material forming the surface of said substrate is substantially identical to that of the material stored in said first local clean space, and the time for which the material forming the surface of said substrate is exposed to the atmosphere after cleaning the material forming the surface of said substrate, is made to be substantially the same as the material stored in said first local clean space.

10. A storehouse as claimed in claim 5, wherein said assessment device includes a substrate, means for dropping a pure water droplet onto the surface of said substrate, means for measuring the contact angle of said dropped water droplet, and means for assessing the contamination occurring on said substrate in view of the contact angle as measured and diagnosing the deterioration of the capability of removing organic substances in said means for generating the clean air for storage.

11. A storehouse as claimed in claim 10, wherein the quality of the material forming the surface of said substrate is substantially identical to that of the material stored in said first local clean space, and the time for which the material forming the surface of said substrate is exposed to the atmosphere after cleaning material forming the surface of said substrate is made to be substantially the same as the material stored in said first local clean space.

12. A storehouse for use in storage of a clean material comprising:

an environmental clean space kept at a level of a first cleanliness;

a first local clean space isolated from said environmental clean space and provided with a storage means for storing the clean material;

means for generating clean air for storage, said clean air being controlled to have a second cleanliness level such that the contact angle of a pure water droplet or the surface resistivity to the clean material surface can be kept at substantially the same level as that immediately after cleaning the material; and means for supplying said clean air for storage to said first local space.

13. A storehouse as claimed in claim 12, wherein said means for generating the clean air for storage is provided with means for removing hydrocarbon groups contained in outdoor air or the air in said environmental clean space by decomposing said hydrocarbon groups using a method of combustion with a catalyst.

14. A storehouse as claimed in claim 12, wherein said means for generating the clean air for storage is provided with means for removing hydrocarbon groups contained in outdoor air or the air in said environmental clean space by an activated charcoal filter capable of adsorbing said hydrocarbon groups.

15. A storehouse as claimed in claim 12, wherein said means for generating the clean air for storage is provided with means for removing hydrocarbon groups contained in outdoor air or the air in said environmental clean space by employing a fluid bed adsorbing tower using activated charcoal.

16. A storehouse as claimed in claim 13, wherein said means for generating the clean air for storage is provided, at a downstream side of said means for removing said hydrocarbon groups, with a high efficiency filter which is capable of removing particulates having a size of 0.3 μm at an efficiency of 99.97% or more and is made of only materials which generate no gaseous impurities.

17. A storehouse as claimed in claim 15, wherein said means for generating the clean air for storage is provided, at a downstream side of said means for removing said hydrocarbon groups, with a medium efficiency filter capable of removing particulates having a size of 0.3 μm or more at an efficiency of less than 99.97% and is made of only materials which generate no gaseous impurities, and a high efficiency filter capable of removing particulates having a size of 0.3 μm at an efficiency of 99.97% or more and is made of only materials which generate no gaseous impurities.

18. A storehouse as claimed in claim 12, wherein said first local clean space comprises a storage space in which said storage means is set up, and a buffer space intervening between said storage space and said environmental clean space, said storage space being isolated from said buffer space by a partition wall which can be opened and shut, and also said buffer space being isolated from said environmental space by the like partition wall.

19. A storehouse as claimed in claim 18, wherein said means for generating clean air for storage supplies the clean air for storage from said storage space to said buffer space.

20. A storehouse as claimed in claim 12, further comprising a second local clean space which is isolated from said first local clean space and said environmental clean space, a gas introducing means for introducing the clean air for storage from said first local clean space into said second local clean space, and an assessment device for assessing organic contamination caused by the clean air for storage.

21. A storehouse as claimed in claim 20, wherein said means for generating clean air for storage includes a plurality of air supply systems which are made independent from each other and can be switched from one to the other to supply said clean air for storage to said first local clean space in response to the assessment result attained by said assessment device.

22. A storehouse as claimed in claim 20, further comprising an inert gas supply means for supplying an inert gas to said first local clean space, and said means for generating clean air for storage is switched to said inert gas supply in response to the assessment result obtained by said assessment device.

23. A storehouse as claimed in claim 20, wherein said assessment device includes a substrate at least the surface of which is insulated, a surface resistivity meter for measuring the electric resistance between at least two points on said substrate, means for introducing to said second local clean airspace a humidity controlled gas having a substantially constant relative humidity, and means for assessing the contamination occurring on said substrate in view of the surface resistivity measured by said surface resistivity meter and diagnosing the deterioration of the capability of removing organic substances in said means for generating the clean air for storage.

24. A storehouse as claimed in claim 23, wherein the quality of the material forming the surface of said substrate is substantially identical to that of the material stored in said first local clean space, and the time for which the material forming the surface of said substrate is exposed to the atmosphere after cleaning the material forming the surface of said substrate, is made to be substantially the same as the material stored in said first local clean space.

25. A storehouse as claimed in claim 20, wherein said assessment device includes a substrate, means for dropping a pure water droplet onto the surface of said substrate, means for measuring the contact angle of said dropped water droplet, and means for assessing the contamination occurring on said substrate in view of the contact angle as measured and diagnosing the deterioration of the capability of removing organic substances in said means for generating the clean air for storage.

26. A storehouse as claimed in claim 25, wherein the quality of the material forming the surface of said substrate is substantially identical to that of the material stored in said first local clean space, and the time for which the material forming the surface of said substrate is exposed to the atmosphere after cleaning material forming the surface of said substrate is made to be substantially the same as the material stored in said first local clean space.

* * * * *